US008146550B2

(12) United States Patent
Takemura

(10) Patent No.: US 8,146,550 B2
(45) Date of Patent: Apr. 3, 2012

(54) VARIABLE VALVE TIMING CONTROL APPARATUS FOR INTERNAL COMBUSTION ENGINE

(75) Inventor: Yuichi Takemura, Toyohashi (JP)

(73) Assignee: Denso Corporation, Kariya (JP)

( * ) Notice: Subject to any disclaimer, the term of this patent is extended or adjusted under 35 U.S.C. 154(b) by 358 days.

(21) Appl. No.: 12/629,306

(22) Filed: Dec. 2, 2009

(65) Prior Publication Data

US 2010/0139592 A1 Jun. 10, 2010

(30) Foreign Application Priority Data

Dec. 9, 2008 (JP) ..... 2008-312844

(51) Int. Cl.
*F01L 1/34* (2006.01)

(52) U.S. Cl. ..... 123/90.17; 123/90.15; 464/160

(58) Field of Classification Search ..... 123/90.15, 123/90.17; 464/1, 2, 160
See application file for complete search history.

(56) References Cited

U.S. PATENT DOCUMENTS 5,738,056 A 4/1998 Mikame et al.
6,330,870 B1 12/2001 Inoue et al.
6,418,896 B2 7/2002 Ogawa
7,845,321 B2 * 12/2010 Kobaishi ..... 123/90.17

FOREIGN PATENT DOCUMENTS

JP 2002-250239 9/2002

* cited by examiner

*Primary Examiner* — Ching Chang
(74) *Attorney, Agent, or Firm* — Nixon & Vanderhye PC

(57) ABSTRACT

A variable valve timing control apparatus for an engine includes a variable valve timing unit, a lock pin, a hydraulic control unit, and a lock control unit. The lock control unit causes the lock pin to lock the camshaft phase at an intermediate lock phase when a lock request is issued. When the lock request is issued, the camshaft phase is shifted in a reference direction to go beyond the intermediate lock phase while the lock pin is urged in a lock direction. When the camshaft phase stops around the intermediate lock phase, the lock control unit changes a control amount of the hydraulic control unit by a certain amount to shift the camshaft phase. The lock control unit determines that the camshaft phase has been locked at the intermediate lock phase when the camshaft phase is not shifted even after the lock control unit changes the control amount.

16 Claims, 19 Drawing Sheets

OIL PASSAGE RESTRICTION
(SLIGHT ADVANCE)

| | | | | |
|---|---|---|---|---|
| ADVANCE PORT | CLOSED | SUPPLY | HOLD | DRAIN |
| RETARD PORT | DRAIN | | HOLD | SUPPLY |
| LOCK PIN CONTROL PORT | DRAIN | SUPPLY | | |

VARIABLE VALVE TIMING CONTROL APPARATUS FOR INTERNAL COMBUSTION ENGINE

CROSS REFERENCE TO RELATED APPLICATION

This application is based on and incorporates herein by reference Japanese Patent Application No. 2008-312844 filed on Dec. 9, 2008.

BACKGROUND OF THE INVENTION

1. Field of the Invention

The present invention relates to a variable valve timing control apparatus that adjusts valve timing of an internal combustion engine.

2. Description of Related Art

In a conventional hydraulic variable valve timing unit, as shown in JP-A-H9-324613 (corresponding to U.S. Pat. No. 5,738,056) and JP-A-2001-159330 (corresponding to U.S. Pat. No. 6,330,870), a lock phase during engine stop is set at a generally middle phase within an adjustable range of a camshaft phase such that the adjustable range of valve timing (camshaft phase) is enlarged. In the above conventional art, an intermediate lock phase, at which the phase is locked during the engine stop, is set at a phase suitable for starting the engine. The engine is started while the camshaft phase is at the intermediate lock phase. Also, after starting the engine, the lock is released such that valve timing (camshaft phase) is shifted toward a target phase in the retard direction or in the advance direction. Then, when the engine is stopped, the camshaft phase is controlled at a position on an advance side of the intermediate lock phase. In the above state, oil pressure supplied to the variable valve timing unit is reduced such that the camshaft phase is shifted in the retard direction by cam torque. When the camshaft phase reaches the intermediate lock phase during the process of the shift, a spring pushes a lock pin into a lock hole, and thereby the camshaft phase is locked at the intermediate lock phase.

In the conventional variable valve timing control apparatus, it is determined that the lock has been completed if the camshaft phase stops around the intermediate lock phase in a process, where the camshaft phase is shifted in the retard by the cam torque when the engine is controlled to be stopped. As a result, in a case, where the camshaft phase erroneously stops at a certain phase slightly different from the intermediate lock phase due to some reasons (for example, a condition of oil temperature), it may be erroneously determined that the lock has been completed although the camshaft phase is not locked actually.

Also, in the conventional art, the lock is released such that the camshaft phase is shifted in the retard direction or in the advance direction after the completion of the engine start. However, there may be a case, where the release of the lock is delayed due to some reasons (for example, frictional force between the lock pin and an inner periphery edge of the lock hole, or delay in the increase of oil pressure). In the usual operation, when the lock release request is issued, the camshaft phase is phase feed-back controlled to be shifted in the retard direction or in the advance direction based on the target phase while the lock pin is actuated by the oil pressure in the lock release direction. In the above operation, because of the above delay of the lock release, the lock pin may be firmly urged against the inner periphery edge of the lock hole by the driving force, which shifts the camshaft phase toward the target phase, while the lock pin is being pulled out of the lock hole. As a result, the lock pin is disabled to get out of the lock hole, and thereby the lock may be prevented from being released disadvantageously.

SUMMARY OF THE INVENTION

The present invention is made in view of the above disadvantages. Thus, it is an objective of the present invention to address at least one of the above disadvantages.

To achieve the objective of the present invention, there is provided a variable valve timing control apparatus for an internal combustion engine that has a camshaft and a crankshaft, the variable valve timing control apparatus including a variable valve timing unit, a lock pin, a hydraulic control unit, and a lock control unit. The variable valve timing unit is adapted to adjust valve timing by shifting a camshaft phase that is a rotational angular position of the camshaft relative to a rotational angular position of the crankshaft. The lock pin is movable in a lock direction for locking the camshaft phase at an intermediate lock phase that is generally middle of an adjustable range of the camshaft phase. The hydraulic control unit is adapted to control oil pressure that actuates the variable valve timing unit and the lock pin. The lock control unit controls the hydraulic control unit such that the lock pin is caused to lock the camshaft phase at the intermediate lock phase when a lock request is issued. When the lock request is issued, the lock control unit executes a phase shift control while the lock pin is urged in the lock direction, in which control the lock control unit controls the hydraulic control unit such that the camshaft phase is shifted in a reference direction to go beyond the intermediate lock phase. When the camshaft phase stops around the intermediate lock phase during the phase shift control, the lock control unit changes a control amount of the hydraulic control unit by a certain amount to shift the camshaft phase. The lock control unit determines that the camshaft phase has been locked at the intermediate lock phase when the camshaft phase is limited from being shifted even after the lock control unit changes the control amount of the hydraulic control unit by the certain amount.

To achieve the objective of the present invention, there is also provided a variable valve timing control apparatus for an internal combustion engine that has a camshaft and a crankshaft, the variable valve timing control apparatus including a variable valve timing unit, a lock pin, a hydraulic control unit, and a lock release control unit. The variable valve timing unit is adapted to adjust valve timing by shifting a camshaft phase that is a rotational angular position of the camshaft relative to a rotational angular position of the crankshaft. The lock pin is movable in a lock direction for locking the camshaft phase at an intermediate lock phase that is generally middle of an adjustable range of the camshaft phase. The hydraulic control unit is adapted to control oil pressure that actuates the variable valve timing unit and the lock pin. Operation of the hydraulic control unit is changeable between a lock mode and a phase feed-back control mode. When the hydraulic control unit is operated in the lock mode, the lock pin locks the camshaft phase at the intermediate lock phase. When the hydraulic control unit is operated in the phase feed-back control mode, the variable valve timing unit controls the camshaft phase at a target phase. The lock release control unit controls the hydraulic control unit such that the lock pin is actuated in a lock release direction for releasing the locked camshaft phase when a lock release request is issued during the lock mode. The lock release control means is prevented from changing the operation of the hydraulic control unit to the phase feed-back control mode and the lock release control means controls the hydraulic control unit such that the camshaft phase is controlled around the intermediate lock phase while the lock pin is actuated in the lock release direction until a certain period of time elapses since the lock release request is issued. The lock release control means changes the operation of the hydraulic control unit to the phase feed-back control mode after the certain period of time elapses since the lock release request is issued.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF EMBODIMENTS

First and second embodiments, which applies the present invention to a variable valve timing control apparatus for adjusting an intake valve, will be described below.

First Embodiment

The first embodiment of the present invention will be described with reference to FIGS. 1 to 10.

Figure 1:
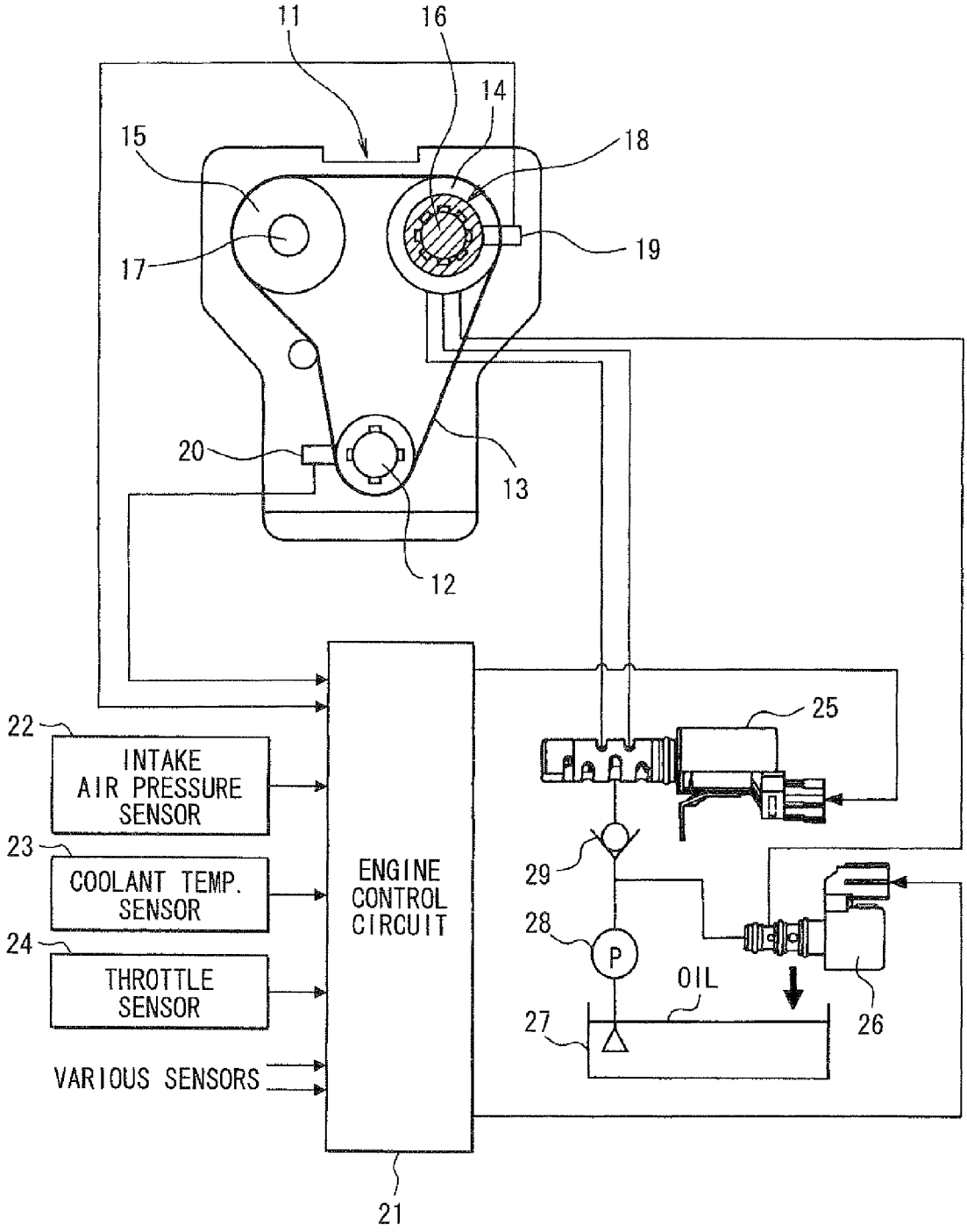
FIG. 1 is a schematic configuration generally illustrating a control system according to the first embodiment of the present invention.

As shown in FIG. 1, an engine 11 (internal combustion engine) transmits drive force from a crankshaft 12 to an intake camshaft 16 and an exhaust camshaft 17 through a timing chain 13 and sprockets 14, 15. The intake camshaft 16 is provided with a variable valve timing unit 18 that adjusts an advance amount (or a camshaft phase) of the intake camshaft 16 relative to the crankshaft 12. More specifically, the camshaft phase is a rotational angular position of the intake camshaft 16 relative to a rotational angular position of the crankshaft 12.

Also, a cam angle sensor 19 is provided at a position radially outward of the intake camshaft 16 for outputting cam angle signal pulses at predetermined cam angles in order to identify cylinders. Also, a crank angle sensor 20 is provided at a position radially outward of the crankshaft 12 for outputting crank angle signal pulses at predetermined crank angles. The signals outputted from the cam angle sensor 19 and the crank angle sensor 20 are fed to an engine control circuit 21. The engine control circuit 21 computes actual valve timing (actual camshaft phase) of the intake valve and computes an engine rotation speed based on a frequency (pulse interval) of the output pulses of the crank angle sensor 20. Also, the other signals outputted by various sensors (an intake air pressure sensor 22, a coolant temperature sensor 23, a throttle sensor 24) for detecting an engine operational state are fed to the engine control circuit 21.

The engine control circuit 21 executes fuel injection control and ignition control based on the engine operational state detected by the various sensors. Also, The engine control circuit 21 executes variable valve timing control (phase feed-back control), in which the engine control circuit 21 feed-back controls oil pressure that actuates the variable valve timing unit 18 such that the actual valve timing of the intake valve (or an actual camshaft phase of the intake camshaft 16) becomes target valve timing (target phase).

Figure 2:
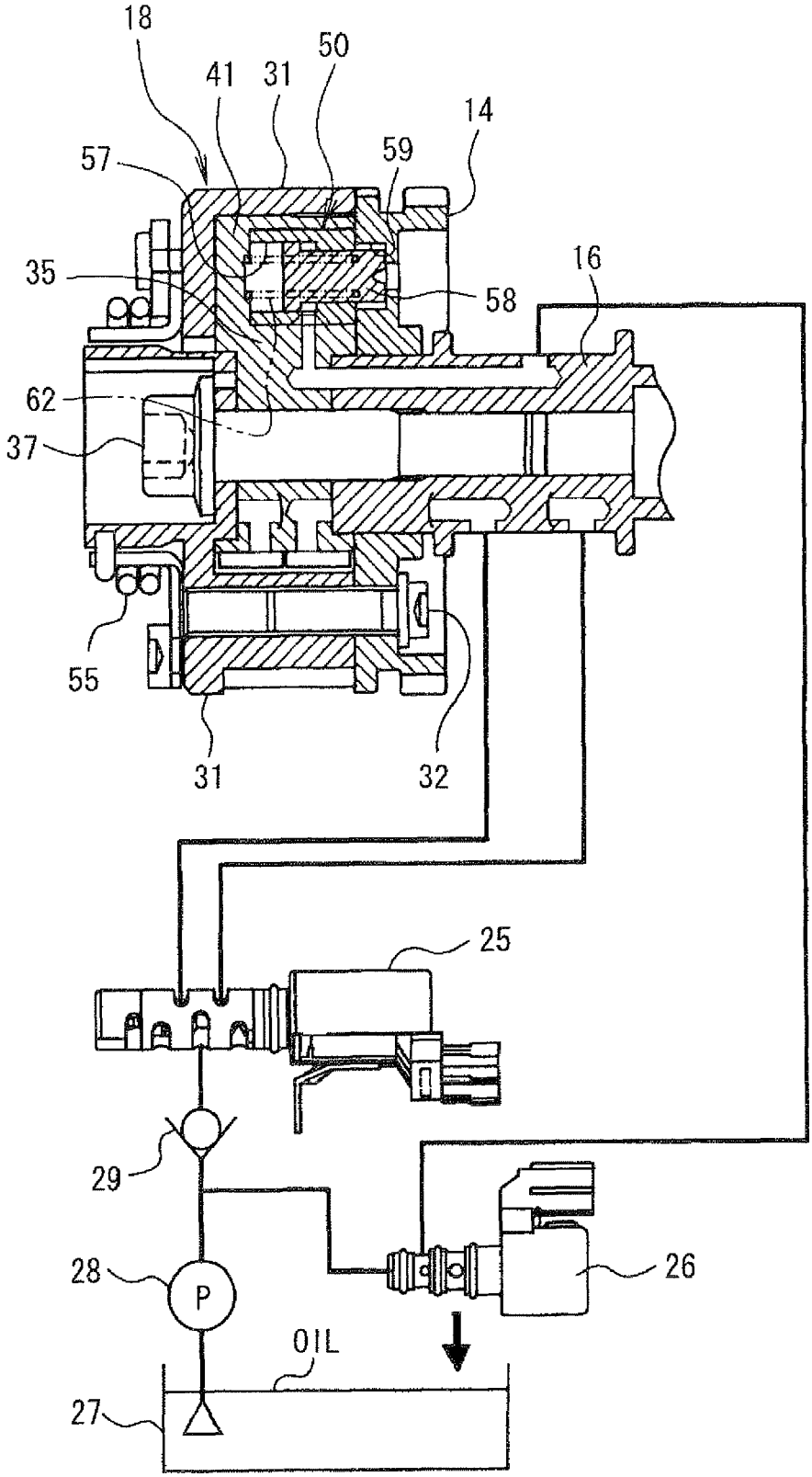
FIG. 2 is a diagram for explaining a variable valve timing unit and a hydraulic control circuit (hydraulic control unit) of the first embodiment.

Next, the variable valve timing unit 18 will be described with reference to FIGS. 2 and 3.

The variable valve timing unit 18 has a housing 31 that is fixed to the sprocket 14 through a bolt 32. The sprocket 14 is movably supported at a position radially outward of the intake camshaft 16. Thus, when the rotation of the crankshaft 12 is transmitted to the sprocket 14 and the housing 31 through the timing chain 13, the sprocket 14 and the housing 31 are rotated synchronously with the crankshaft 12.

The intake camshaft 16 has one end portion that is fixed to a rotor 35 through a bolt 37. The rotor 35 is received within the housing 31 and is rotatable relative to the housing 31.

Figure 3:
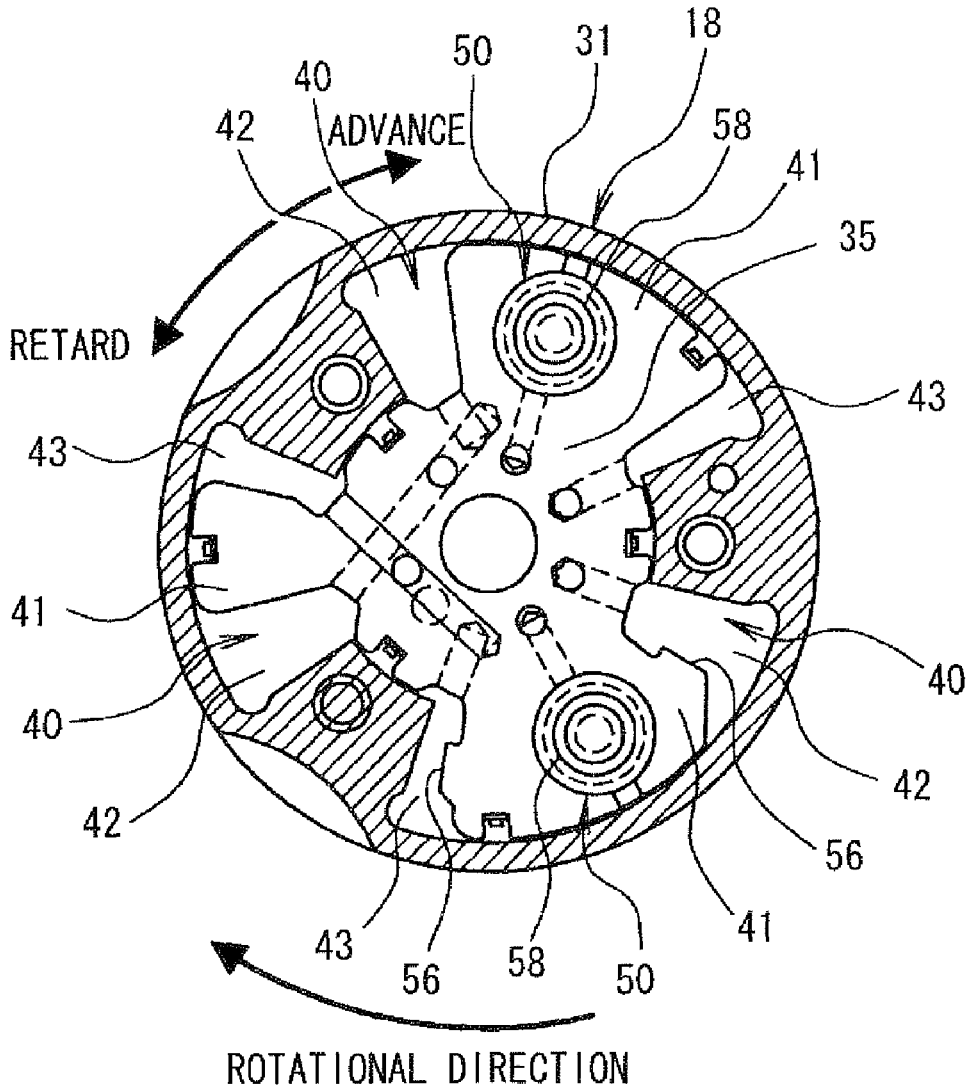
FIG. 3 is a sectional view of the variable valve timing unit of the first embodiment taken along a plane perpendicular to a longitudinal axis of the variable valve timing unit.

As shown in FIG. 3, multiple hydraulic chambers 40 are formed within the housing 31, and vanes 41 are formed at radially outward parts of the rotor 35. Each of the hydraulic chambers 40 is divided into an advance chamber 42 and a retard chamber 43 by the corresponding vane 41. At least one of the vanes 41 has both circumferential ends that are provided with respective stoppers 56. Each of the stoppers 56 limits a rotational range of the rotor 35 (the vane 41) relative to the housing 31. The stoppers 56 defines a full retard phase and a full advance phase of an adjustable range of the camshaft phase.

The variable valve timing unit 18 is provided with an intermediate lock mechanism 50 that is adapted to lock the camshaft phase at an intermediate lock phase. For example, the intermediate lock phase corresponds to a position (phase) generally middle of the above adjustable range. The intermediate lock mechanism 50 will be described below. A lock pin receiving hole 57 is provided to one of the multiple vanes 41, or multiple lock pin receiving holes 57 may be provided to the multiple vanes 41, respectively. The lock pin receiving hole 57 receives therein a lock pin 58 that is displaceable to project from the lock pin receiving hole 57. The lock pin 58 locks the rotation of the rotor 35 (the vane 41) relative to the housing 31 when the lock pin 58 projects from the lock pin receiving hole 57 toward the sprocket 14 to be inserted into a lock hole 59 of the sprocket 14. As a result, the camshaft phase is locked at the intermediate lock phase located generally in the middle of the adjustable range. The intermediate lock phase is set at a phase that is suitable for starting the engine 11. It should be noted that the lock hole 59 may be alternatively provided to the housing 31.

The lock pin 58 is urged by a spring 62 in a lock direction for locking the camshaft phase. In other words, the lock pin 58 is urged in a projection direction, in which the lock pin 58 is capable of projecting from the lock pin receiving hole 57. Also, an hydraulic chamber for releasing the lock is formed between (a) the radially outward part of the lock pin 58 and (b) the lock pin receiving hole 57. The hydraulic chamber is used to control oil pressure that actuates the lock pin 58 in a lock release direction for unlocking the rotation of the rotor 35 to release the locked camshaft phase. For example, when the pressure in the hydraulic chamber becomes high, the lock pin 58 is displaced in the lock release direction. Also, when the pressure in the hydraulic chamber becomes low, or is released, the lock pin 58 is urged in the lock direction by the urging force of the spring 62. It should be noted that the housing 31 is provided with a helical torsion spring 55 (see FIG. 2) that provides spring force for assisting oil pressure applied to rotate the rotor 35 relatively in an advance direction during advance control.

In the first embodiment, a hydraulic control unit, which controls oil pressure that actuates the variable valve timing unit 18 and the lock pin 58, includes a phase-control hydraulic control valve 25 (first hydraulic control valve) and a lock-control hydraulic control valve 26 (second hydraulic control valve). The phase-control hydraulic control valve 25 controls oil pressure that actuates the variable valve timing unit 18, and the lock-control hydraulic control valve 26 controls oil pressure that actuates the lock pin 58. For example, the phase-control hydraulic control valve 25 is a five-port and three-position type spool valve, and the lock-control hydraulic control valve 26 is a three-port and two-position type spool valve.

An oil pump 28 is driven by drive force of the engine 11, and the oil pump 28 pumps oil within an oil pan 27 to supply oil to each of hydraulic control valves 25, 26. The phase-control hydraulic control valve 25 controls oil pressure (oil amount) supplied to the advance chambers 42 and the retard chambers 43 of the variable valve timing unit 18. The lock-control hydraulic control valve 26 controls oil pressure (oil amount) that actuates the lock pin 58 in the lock release direction. It should be noted that the phase-control hydraulic control valve 25 is provided with a check valve 29 at an inlet port side of the hydraulic control valve 25, the check valve 29 limiting backflow of oil.

The engine control circuit 21 computes a target phase (target valve timing) based on an engine operational condition during the phase feed-back control (variable valve timing control) in order to feed-back control a control duty (control amount) of the phase-control hydraulic control valve 25 such that an actual camshaft phase of the intake camshaft 16 (actual valve timing of the intake valve) is caused to become a target phase (target valve timing). Thus, pressure of oil supplied to the advance chambers 42 and the retard chambers 43 of the variable valve timing unit 18 is feed-back controlled by the feed back control of the control duty.

When a lock request is issued during the phase feed-back control, a lock control will be executed as follows. For example, in the lock control, the lock pin 58 is caused to be fitted into the lock hole 59 of the sprocket 14 such that the actual camshaft phase is locked at the intermediate lock phase. Firstly, the operational position of the lock-control hydraulic control valve 26 is changed to the drain port for releasing oil pressure in the lock release hydraulic chamber within the lock pin receiving hole 57 such that the spring 62 urges to displace the lock pin 58 in the lock direction. Then, a phase shift control is executed, in which the phase-control hydraulic control valve 25 is controlled such that the actual camshaft phase is shifted in a shift-control direction to a position beyond the intermediate lock phase while the spring 62 urges the lock pin 58 in the lock direction (projection direction). When the actual camshaft phase stops round the intermediate lock phase during the phase shift control, the control duty of the phase-control hydraulic control valve 25 is further changed by a certain amount such that the actual camshaft phase is further shifted in the shift-control direction. In a case, where the actual camshaft phase is not shifted even after the above further change of the control duty, it is determined that the lock has been completed. For example, the completion of the lock indicates that the actual camshaft phase has been locked at the intermediate lock phase by fitting the lock pin 58 into the lock hole 59.

In the first embodiment, in order to reliably execute the lock control of the lock pin 58 and the determination of the completion of the lock, the following control is executed. For example, when the actual camshaft phase stops around the intermediate lock phase during the phase shift control, the control duty of the phase-control hydraulic control valve 25 is changed by a certain amount alternately (a) for shifting the camshaft phase in the advance direction and (b) for shifting the camshaft phase in the retard direction. When the above alternate change of the control duty does not shift the actual camshaft phase in either direction, it is finally determined that the lock has been completed.

Due to the above configuration, it is possible to reliably lock the camshaft phase at the intermediate lock phase, and simultaneously it is possible to achieve the reliable determination of the completion of the lock.

An operation example of the lock control in the first embodiment will be described with reference to FIG. 4.

Figure 4:
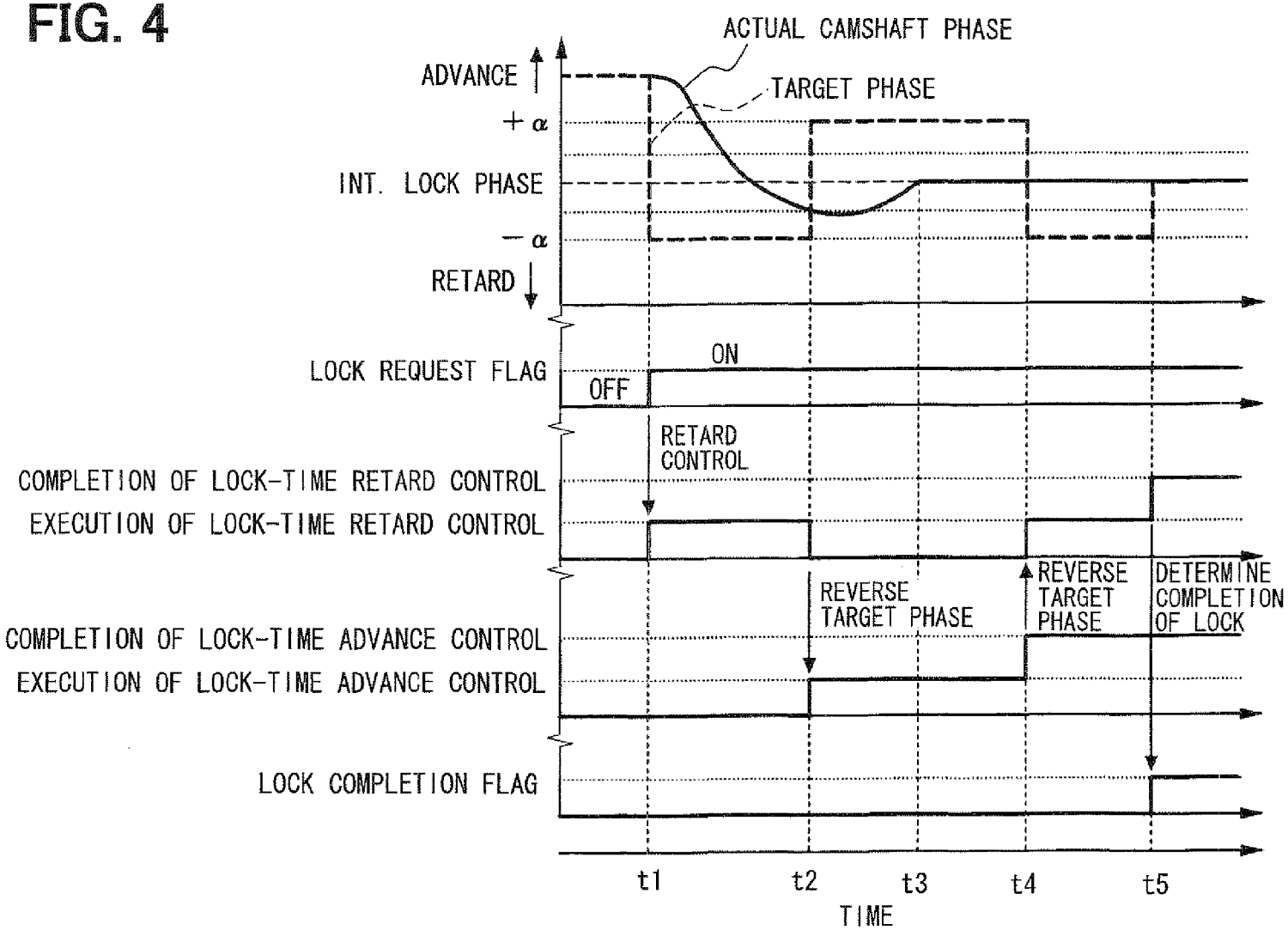
FIG. 4 is a timing chart illustrating an operational example of lock control of the first embodiment.

FIG. 4 is a timing chart illustrating the operation example of the lock control in a state, where the actual camshaft phase is held or controlled at a phase located on an advance side of the intermediate lock phase when the lock request is issued. The lock request is issued at time t1, at which the actual camshaft phase is controlled or held on the advance side of the intermediate lock phase. In response to the lock request, lock-time retard control is executed, in which the target phase is changed to a certain phase (intermediate lock phase $-\alpha$) on the retard side of the intermediate lock phase such that the actual camshaft phase is shifted in the retard direction to go beyond the intermediate lock phase from (a) the phase located on the advance side of the intermediate lock phase to (b) the other phase located on the retard side. As above, the lock-time retard control is executed such that the actual camshaft phase is shifted in the retard direction.

When the actual camshaft phase reaches the intermediate lock phase from the advance side due to the lock-time retard control, and thereby the lock pin 58 is fitted into the lock hole 59 to be locked, the actual camshaft phase usually stays at the intermediate lock phase. However, in the example of FIG. 4, the actual camshaft phase has gone beyond or passed the intermediate lock phase from the advance side to the retard side because the lock pin 58 is not fitted into the lock hole 59 due to some reasons in the first-time lock-time retard control (first lock trial).

It is determined at time t2 that the actual camshaft phase has been shifted in the retard direction to certainly go beyond the intermediate lock phase to a phase on the retard side (or that the lock has been failed). The above determination means that, at time t2, the actual camshaft phase has reached a phase positioned apart from the intermediate lock phase in the retard direction by equal to or greater than a certain amount (for example, $\alpha/2$). Thus, at time t2, the lock-time advance control is executed, in which the target phase is again changed to a phase (intermediate lock phase $+\alpha$) on the advance side of the intermediate lock phase such that the actual camshaft phase is shifted in the advance direction to go beyond the intermediate lock phase again.

Due to the above configuration, when the first phase shift control fails in locking the camshaft phase at the intermediate lock phase, the shift-control direction of the camshaft phase is reversed such that the camshaft phase is shifted in the opposite direction (for example, retard direction) opposite from the reference direction (for example, advance direction) in order to lock the camshaft phase at the intermediate lock phase. As a result, it is possible to reliably lock the camshaft phase at the intermediate lock phase.

In the example of FIG. 4, due to the above lock-time advance control (second lock trial), the actual camshaft phase is shifted from the phase located on the retard side of the intermediate lock phase, then the actual camshaft phase reaches the intermediate lock phase at time t3. At time t3, the lock pin 58 is brought into the engagement with the lock hole 59 (lock success), and thereby the actual camshaft phase stays at the intermediate lock phase. It should be noted that in a case, where the time lock-time advance control (second lock trial) also fails the lock, another lock-time retard control (third lock trial) will be executed in order to shift the actual camshaft phase in the retard direction similarly to the first lock trial.

Then, the lock-time advance control is ended at time t4, at which it is detected that the actual camshaft phase stably stops at the intermediate lock phase. Then, in order to confirm that the lock has been completed, the lock-time retard control is executed by changing the target phase to the phase (intermediate lock phase $-\alpha$) located on the retard side of the intermediate lock phase. When it is confirmed at time t5 that the actual camshaft phase is not shifted even after the execution of the above lock-time retard control, it is determined that the lock has been completed. Accordingly, the lock-time retard control is ended.

The operational mode, in which the lock pin 58 locks the actual camshaft phase at the intermediate lock phase, is referred as a lock mode in the present embodiment. When a lock release request is issued during the lock mode, the engine control circuit 21 switches the operational position of the lock-control hydraulic control valve 26 from the drain port to an oil pressure supply port such that oil pressure is supplied to the lock release hydraulic chamber within the lock pin receiving hole 57. Accordingly, the lock pin 58 is actuated in the lock release direction for releasing the lock (or for unlocking the camshaft phase from the intermediate lock phase). At the above time, the operation mode is prevented from being changed into a phase feed-back control mode until the certain period of time has elapsed since the lock release request is issued. Simultaneously, the control duty of the phase-control hydraulic control valve 25 is controlled such that the actual camshaft phase is controlled to stay around the intermediate lock phase while the lock pin 58 is actuated in the lock release direction until the certain period of time has elapsed since the lock release request is issued. When the certain period of time has elapsed since the time of issuing of the lock release request, the control duty of the phase-control hydraulic control valve 25 is controlled such that the operation mode is changed into the phase feed-back control mode. For example, in the phase feed-back control mode, the camshaft phase is feed-back controlled to a target phase that is determined based on an operational state.

In other words, the operation mode is prevented from being changed into the phase feed-back control mode (or the phase-control hydraulic control valve 25 is prevented from being controlled in the phase feed-back control mode) until the certain period of time has elapsed since the lock release request is issued. Also, the lock release control is executed while the actual camshaft phase is controlled to stay around the intermediate lock phase until the certain period of time has elapsed since the lock release request is issued. As a result, it is possible to effectively disengage the lock pin 58 from the lock hole 59. More specifically, due to the above operation, while the lock pin 58 is pulled out of the lock hole 59, the lock pin 58 is effectively limited from being urged against an inner periphery edge of the lock hole 59 by the driving force for shifting the actual camshaft phase in the phase feed-back control. As a result, the possible failure in the disengagement of the lock pin 58 from the lock hole 59 is successfully prevented. Accordingly, after the lock release has been ended, the operation mode is changed into the phase feed-back control mode. Thus, when the lock release request is issued, it is possible to reliably start shifting the actual camshaft phase to the target phase (or to reliably start the phase feed-back control) after the lock has been released.

in the above case, the above certain period of time may be predetermined, or may be determined each time as a required interval between (a) time of the issuing of the lock release request and (b) time of detection of change of the actual camshaft phase. In the present embodiment, it is possible to change the operation mode to the phase feed-back control mode immediately after the detection of the end of the lock release based on change of the actual camshaft phase. Accordingly, the operation mode is effectively early changed to the phase feed-back control mode.

Furthermore, in the first embodiment, for the certain period of time since the lock release request is issued, the control duty (control amount) of the phase-control hydraulic control valve 25 is set at a value based on the intended target phase (the target phase in the phase feed-back control to come). More specifically, during the above interval, when the intended target phase is on the advance side of the intermediate lock phase, the control duty (control amount) of the phase-control hydraulic control valve 25 is set at a value that is a certain amount greater in the advance direction than a hold duty (hold control amount) required to hold the phase at the current position. In contrast, during the above interval, when the intended target phase is on the retard side of the intermediate lock phase, the control duty of the phase-control hydraulic control valve 25 is set at a value that is a certain amount greater than the hold duty in the retard direction.

Due to the above configuration, when the actual camshaft phase is to be shifted in the advance direction by the following phase feed-back control mode, the control duty of the phase-control hydraulic control valve 25 is set at a certain target value such that firstly, the lock is released in a state, where the lock pin 58 is gently urged in the advance direction within a movable range of the lock pin 58 in the lock hole 59 and is accordingly gently pressed against the inner periphery edge of the lock hole 59. Then, the operation mode is changed into the phase feed-back control mode such that the actual camshaft phase is effectively quickly shifted in the advance direction. In the above operation, the certain target value of the control duty may correspond to a boundary phase between (a) an advance side of a dead zone range and (b) a range for the hold duty. For example, the actual camshaft phase is not changed even when the control duty is changed with in the dead zone range. Alternatively, the certain target value of the control duty may correspond to a phase positioned apart from the dead zone range in the advance direction by a small amount.

Similarly, when the actual camshaft phase is to be shifted in the retard direction in the phase feed-back control mode, the control duty of the phase-control hydraulic control valve 25 is set at the other certain target value such that, firstly, the lock is released in a state, where the lock pin 58 is gently urged in the retard direction within the movable range of the lock pin 58 in the lock hole 59 and is accordingly gently pressed against the inner periphery edge of the lock hole 59. Then, the operation mode is changed into the phase feed-back control mode such that the actual camshaft phase is effectively quickly shifted in the retard direction. As a result, when the operation mode is changed into the phase feed-back control mode, it is possible to quickly shift the actual camshaft phase in the retard direction and also in the advance direction. In the above operation, the other certain target value of the control duty may correspond to a boundary phase between (a) a retard side of a dead zone range and (b) the range for the hold duty. Alternatively, the other certain target value of the control duty may correspond to a phase positioned apart from the dead zone range in the retard direction by a small amount.

Figure 5:
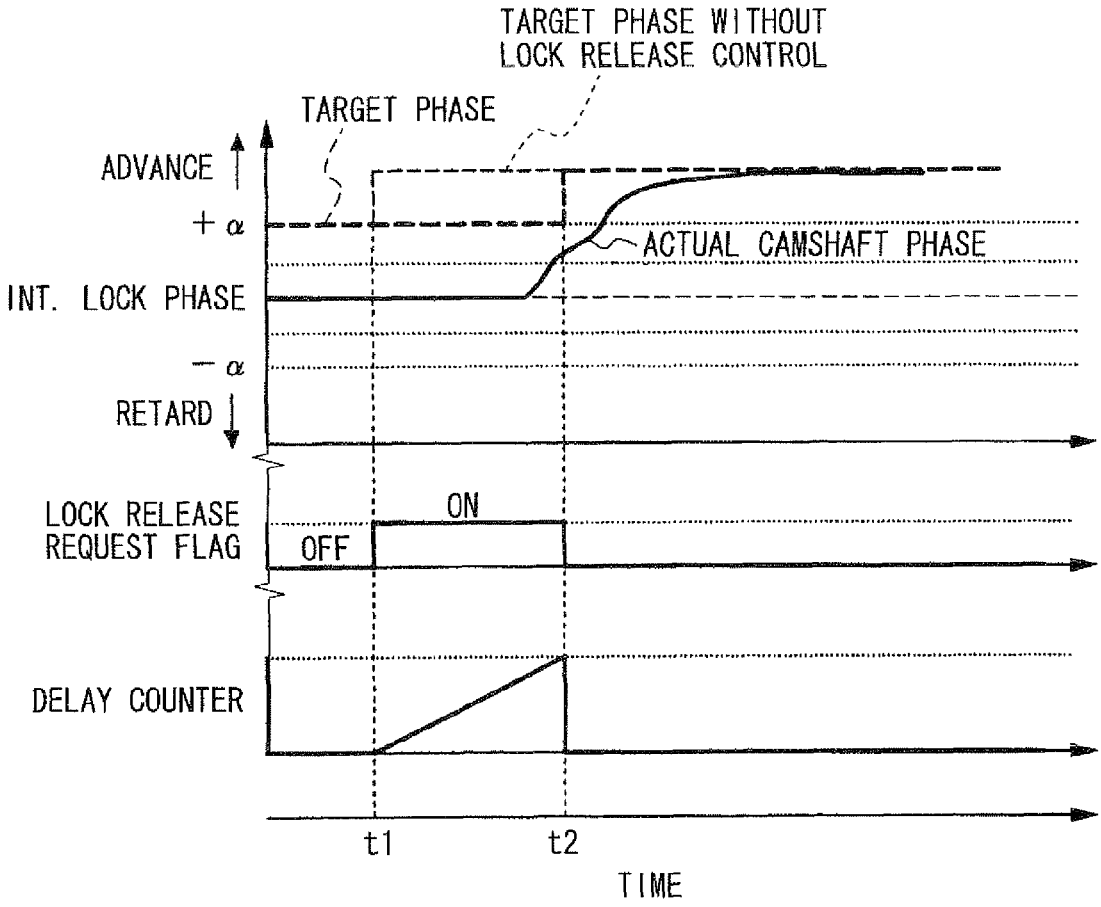
FIG. 5 is a timing chart illustrating an operational example of lock release control of the first embodiment.

An operation example of the lock release control of the first embodiment will be described with reference to FIG. 5.

Even when the lock release request is issued at time t1 during the lock mode, the change of the operation mode into the phase feed-back control mode is prevented during the period (t1 to t2) from time t1 until the certain time elapses. If the intended target phase is on the advance side of the intermediate lock phase, the control duty of the phase-control hydraulic control valve 25 is set at a value that is greater than (or is different from) the hold duty by the certain amount $\alpha$ in the advance direction. Then, the lock-control hydraulic control valve 26 is switched from the drain port to the oil pressure supply port such that oil pressure is supplied to the lock release hydraulic chamber within the lock pin receiving hole 57, and thereby the lock pin 58 is actuated in the lock release direction to release the lock.

Then, at time t2, when the certain time has elapsed since the lock release request is issued, the lock release request is cancelled, and the operation mode is changed to the phase feed-back control mode. Thus, the target phase is computed based on the engine operational condition in order to feed-back control the control duty of the phase-control hydraulic control valve 25 such that the actual camshaft phase of the intake camshaft 16 becomes the target phase.

It should be noted that even before the certain time has elapsed (before time t2) since the time of the issuing of the lock release request, the operation mode may be changed to the phase feed-back control mode immediately when it is detected that the actual camshaft phase is shifted from the intermediate lock phase (that means the lock release has been completed). For example, the above detection may be made by determining whether the actual camshaft phase is shifted from the intermediate lock phase by an amount equal to or greater than the certain amount (for example. $\alpha/2$).

The lock control and the lock release control of the first embodiment are executed by the engine control circuit 21 based on routines shown in FIGS. 6 to 10. Process of each of the routines will be described below.

[Lock Control Main Routine]

Figure 6:
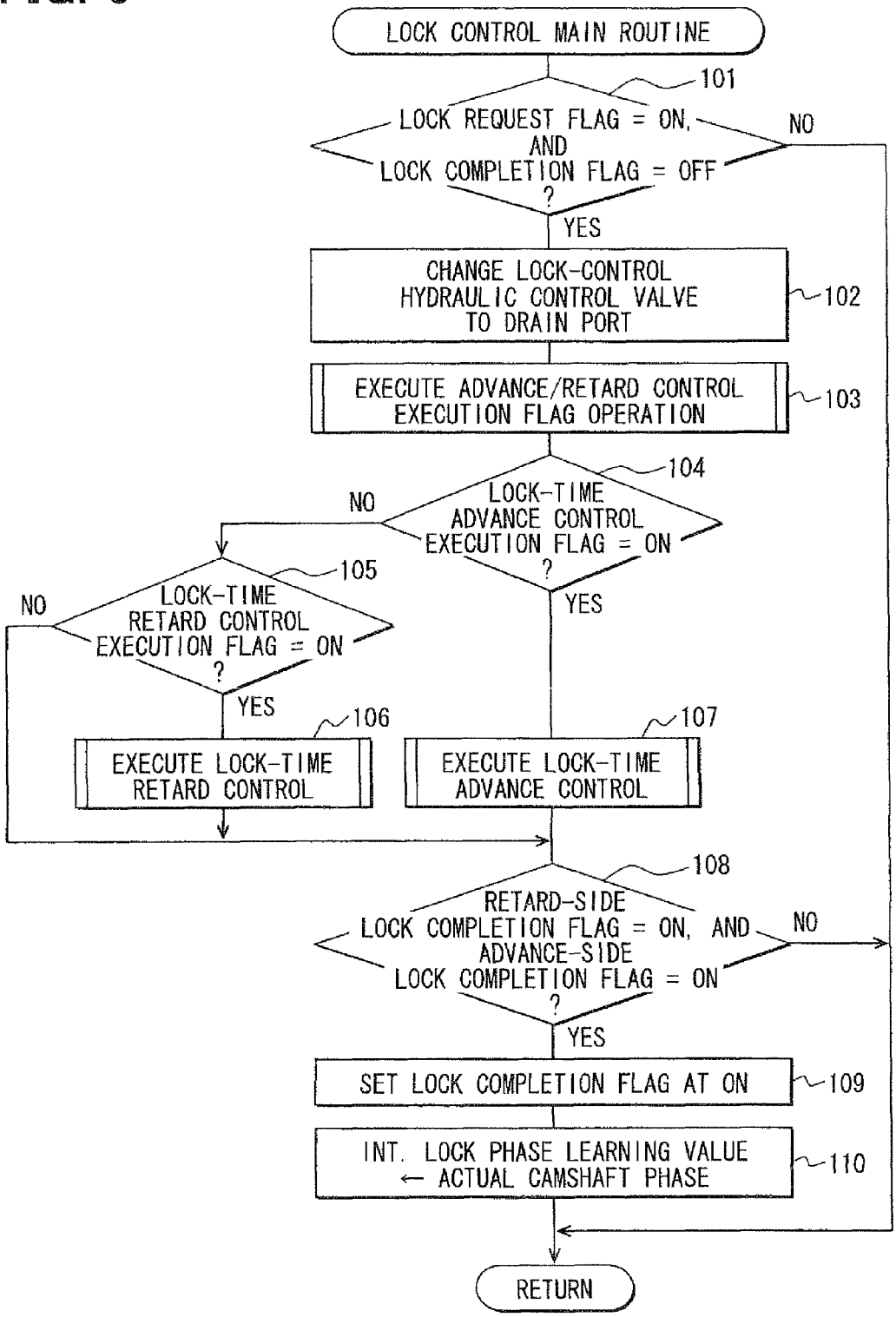
FIG. 6 is a flow chart illustrating a process of a lock control main routine of the first embodiment.

A lock control main routine of FIG. 6 is repeatedly executed at certain intervals during the operation of the engine and serves as lock control means. When the present routine is started, firstly, it is determined at step 101 whether a lock control execution condition is satisfied. For example, the lock control execution condition is satisfied when a lock request flag indicates "ON", corresponding to that there is the lock request, and simultaneously when a lock completion flag indicates "OFF", corresponding to that the lock has not been completed. As a result, when one or both of the lock request flag=OFF and the lock completion flag=ON is true, the lock control execution condition is not satisfied. Accordingly, the present routine is ended without executing the following process.

In contrast, when it is determined at step 101 that the lock request flag=ON and the lock completion flag=OFF, the lock control execution condition is satisfied, and control proceed to steps 102 and later to execute the lock control as follows. Firstly, at step 102, the operational position of the lock-control hydraulic control valve 26 is changed from the oil pressure supply port to the drain port such that oil pressure in the lock release hydraulic chamber within the lock pin receiving hole 57 is released. Thus, the lock pin 58 is urged in the lock direction (projection direction) by the spring 62.

Figure 7:
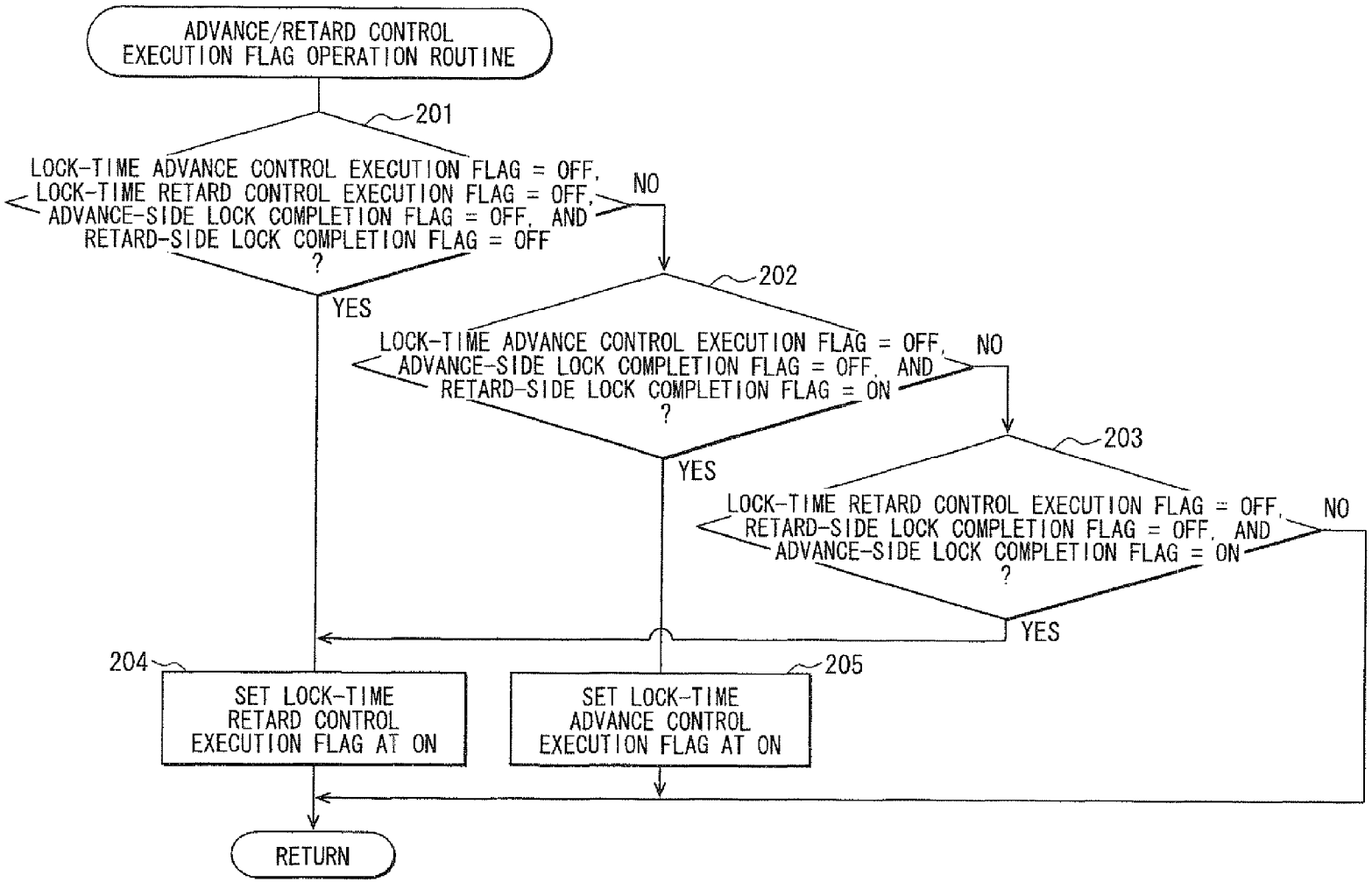
FIG. 7 is a flow chart illustrating a process of an advance and retard control execution flag operation routine of the first embodiment.

Then, control proceeds to step 103, where an advance and retard control execution flag operation routine of FIG. 7 is executed such that ON/OFF of a lock-time retard control execution flag and a lock-time advance control execution flag are switched (details will be describe later). In the above, ON/OFF of the lock-time retard control execution flag is changed based on whether an execution condition of the lock-time retard control for shifting the actual camshaft phase in the retard direction is satisfied or not. Also, ON/OFF of the lock-time advance control execution flag is changed based on whether an execution condition of the lock-time advance control for shifting the actual camshaft phase in the advance direction is satisfied or not.

Figure 8:
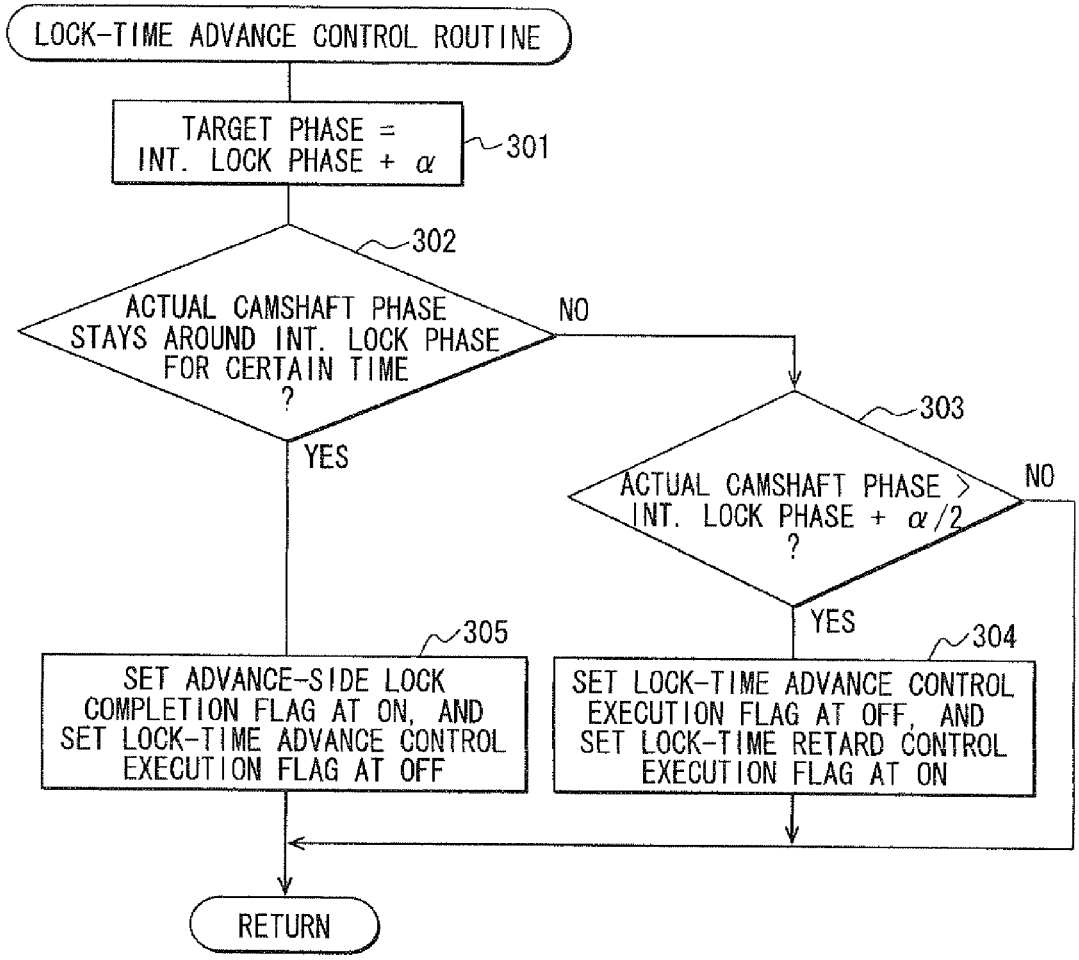
FIG. 8 is a flow chart illustrating a process of a lock-time advance control routine of the first embodiment.

Then, control proceeds to step 104, where it is determined whether the lock-time advance control execution flag is "ON", corresponding to that the lock-time advance control execution condition is satisfied. When it is determined at step 104 that the lock-time advance control execution flag=ON (the execution condition of the lock-time advance control is satisfied), control proceeds to step 107, where a lock-time advance control routine of FIG. 8 is executed.

Figure 9:
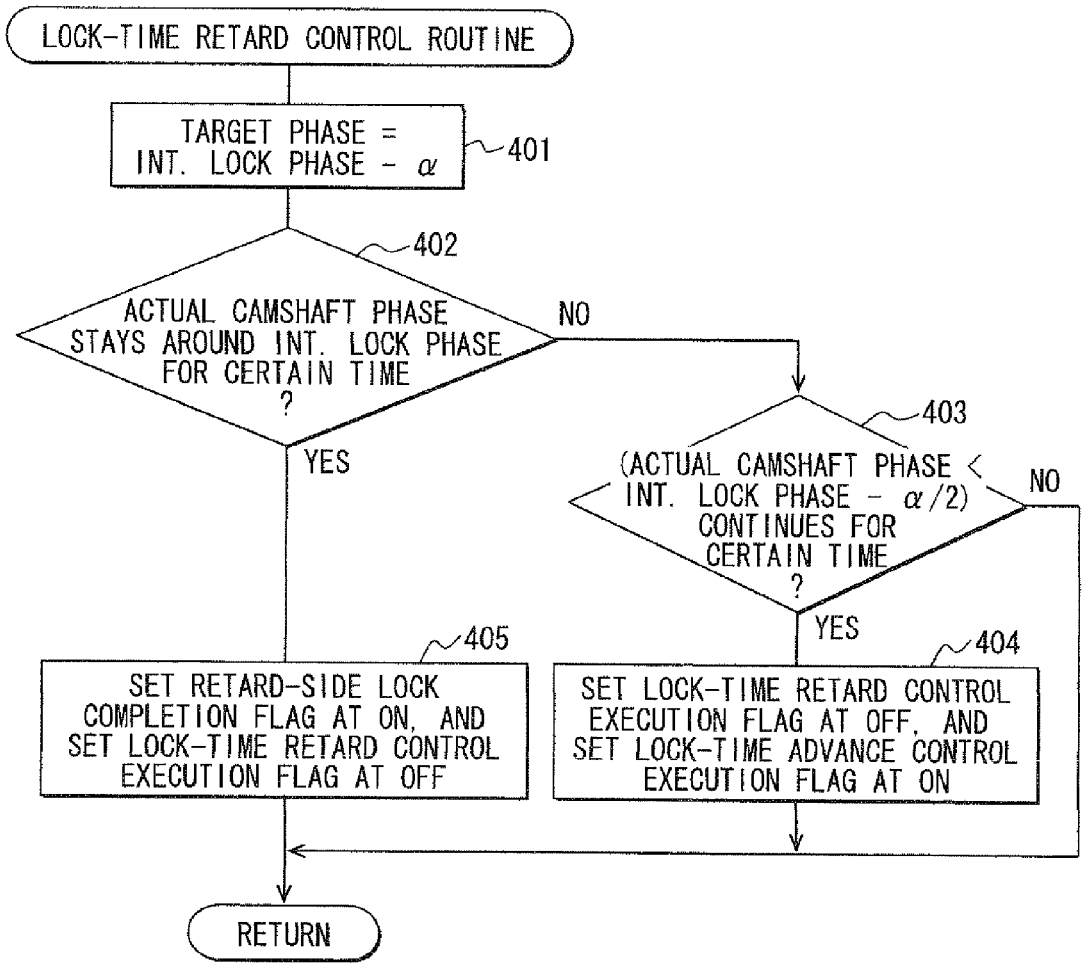
FIG. 9 is a flow chart illustrating a process of a lock-time retard control routine of the first embodiment.

In contrast, when it is determined at step 104 that the lock-time advance control execution flag is "OFF", corresponding to that the lock-time advance control execution condition is not satisfied, control proceeds to step 105, where it is determined whether the lock-time retard control execution flag is "ON", corresponding to that the lock-time retard control execution condition is satisfied. When it is determined at step 105 that the lock-time retard control execution flag is "ON" (the execution condition of the lock-time retard control is satisfied), control proceeds to step 106, where a lock-time retard control routine of FIG. 9 is executed as described later.

It should be noted that when it is determined as "No" in both of the above step 104 and step 105, both of the lock-time retard control and the lock-time advance control are not executed.

Then, control proceeds to step 108, where it is determined whether a retard-side lock completion flag is "ON" and simultaneously an advance-side lock completion flag is "ON". More specifically, "ON" of the retard-side lock completion flag indicates that the lock operation by the lock-time retard control has been completed. Also, "ON" of the advance-side lock completion flag indicates that the lock operation of the lock-time advance control has been completed. When one or both of the retard-side lock completion flag and the advance-side lock completion flag is determined to be "OFF", the present routine is ended. In other words, when it has been determined that one or both of the lock operation by the lock-time retard control and the other lock operation by the lock-time advance control has not completed.

In contrast, when it is determined at step 108 that both the retard-side lock completion flag and the advance-side lock completion flag indicate "ON" (when it is determined that both of the lock operation by the lock-time retard control and the lock operation by the lock-time advance control have been completed), control proceeds to step 109, where it is finally determined that the lock has been completed. Then, the lock completion flag is set at "ON" to indicate that the lock has been completed, and control proceeds to step 110, where the current actual camshaft phase is stored in a rewritable nonvolatile memory (storage device), such as a backup RAM for update of a learning value of the intermediate lock phase. Then, the present routine is ended. The learning value of the intermediate lock phase is used in the execution of the lock control and the lock release control.

[Advance and Retard Control Execution Flag Operation Routine]

The advance and retard control execution flag operation routine of FIG. 7 is a subroutine executed at step 103 in the lock control main routine of FIG. 6. When the present routine is started, firstly, it is determined at step 201 whether all of the lock-time advance control execution flag, the lock-time retard control execution flag, the advance-side lock completion flag, the retard-side lock completion flag indicate "OFF". When it is determined that all of the above four flags indicate "OFF", control proceeds to step 204, where the lock-time retard control execution flag is set at "ON" to end the present routine.

In contrast, when it is determined at step 201 that one or more of the above four flags indicates "ON", control proceeds to step 202, where it is determined whether both of the lock-time advance control execution flag and the advance-side lock completion flag are "OFF" and simultaneously the retard-side lock completion flag is "ON". When the above determination result at step 202 is "Yes", control proceeds to step 205, where the lock-time advance control execution flag is set at "ON" to end the present routine.

When both of the determination results at step 201 and step 202 are "No", control proceeds to step 203, where it is determined whether both of the lock-time retard control execution flag and the retard-side lock completion flag are "OFF" and simultaneously the advance-side lock completion flag is "ON". When the above determination result at step 203 is "Yes", control proceeds to step 204, where the lock-time retard control execution flag is set at "ON".

It should be noted that when all of the determination results at steps 201 to 203 are "No", the present routine is ended without executing any process.

[Locked-Time Advance Control Routine]

The lock-time advance control routine of FIG. 8 is a subroutine executed at step 107 of the Lock control main routine of FIG. 6. When the present routine is started, firstly, at step 301, the lock-time advance control is executed. More specifically, in the lock-time advance control, the phase-control hydraulic control valve 25 is controlled such that the actual camshaft phase becomes the target phase by setting the target phase of the lock-time advance control to a phase (intermediate lock phase $+\alpha$) that is greater by a certain amount $\alpha$ than the intermediate lock phase in the advance direction. In the above, the intermediate lock phase may employ the learning value of the intermediate lock phase, which is learned at step 110 of the Lock control main routine of FIG. 6. When the learning value of the intermediate lock phase is not available, a design value for the intermediate lock phase may be employed. Alternatively, a median or an average value of a range of manufacture variation may also be employed. Data sets of the design value of the intermediate lock phase or the median or the average value of the manufacture variation range may be prestored in a nonvolatile memory, such as a ROM, during a vehicle manufacturing process. Also, the certain amount $\alpha$ may be set such that the target phase (intermediate lock phase $+\alpha$) corresponds to a phase located slightly apart from the dead zone range in the advance direction.

Then, control proceeds to step 302, where it is determined whether the actual camshaft phase stays around the intermediate lock phase for a certain period of time. In the above, the determination of whether the actual camshaft phase is around the intermediate lock phase may be made, for example, by determining whether the actual camshaft phase stays within an error range relative to the learning value of the intermediate lock phase (or the design value, the median, the average value).

When it is determined at step 302 that the actual camshaft phase stays around the intermediate lock phase for the certain period of time, it is determined that the lock operation by the lock-time advance control has been completed. Thus, control proceeds to step 305, where the advance-side lock completion flag is set at "ON", and also the lock-time advance control execution flag is set at "OFF" to end the lock-time advance control.

In contrast, when it is determined at step 302 that the actual camshaft phase has not stayed around the intermediate lock phase for the certain period of time, control proceeds to step 303, where it is determined whether the actual camshaft phase has been certainly shifted in the advance direction to go beyond the intermediate lock phase. For example, the determination of whether the actual camshaft phase has been certainly shifted to go beyond the intermediate lock phase is made by determining whether the actual camshaft phase is shifted to a certain phase that is apart from the intermediate lock phase in the advance direction by a degree equal to or greater than a certain amount (for example, $\alpha/2$). When it is determined at step 303 that the actual camshaft phase has been shifted to the above certain phase, it is determined that the lock operation by the lock-time advance control is failed. Thus, control proceeds to step 304, where the lock-time advance control execution flag is set at "OFF" to end the lock-time advance control, and the lock-time retard control execution flag is set at "ON". Thus, the lock operation by the lock-time retard control is executed based on the lock-time retard control routine of FIG. 9 as described later.

It should be noted that when both of the determination results at step 302 and step 303 are "No", the present routine is ended without executing any process.

[Lock-Time Retard Control Routine]

The lock-time retard control routine of FIG. 9 is a subroutine executed at step 106 of the Lock control main routine of FIG. 6. When the present routine is started, firstly, the lock-time retard control is executed at step 401. For example, in the lock-time retard control, the phase-control hydraulic control valve 25 is controlled such that the actual camshaft phase becomes the target phase by setting the target phase of the lock-time retard control to a phase (intermediate lock phase $-\alpha$) that is smaller than (or is different from) the intermediate lock phase by a certain amount $\alpha$ in the retard direction. In the above, the intermediate lock phase may employ the learning value of the intermediate lock phase, the design value, or the median or the average value of the manufacture variation range. Also, the certain amount $\alpha$ may be set such that the target phase (intermediate lock phase $-\alpha$) is located slightly apart from the dead zone range in the retard.

Then, control proceeds to step 402, where it is determined whether the actual camshaft phase has stayed around the intermediate lock phase for the certain period of time based on a method similar to the method used in the lock-time advance control. When it is determined at step 402 that the actual camshaft phase has stayed around the intermediate lock phase for the certain period of time, it is determined that the lock operation by the lock-time retard control has been completed. Thus, control proceeds to step 405, where the retard-side lock completion flag is set at "ON", and also the lock-time retard control execution flag is set at "OFF" to end the lock-time retard control.

In contrast, when it is determined at step 402 that the actual camshaft phase has not stayed around the intermediate lock phase for the certain period of time, control proceeds to step 403, where it is determined that a certain state of the actual camshaft phase has continued for the certain period of time since the lock-time retard control started. In other words, it is determined at step 403 whether the actual camshaft phase is certainly shifted in the retard direction to go over the intermediate lock phase. In the above determination, the certain state of the actual camshaft phase indicates that the actual camshaft phase stays at a phase located apart from the intermediate lock phase in the retard direction by a degree equal to or greater than the certain amount (for example, $\alpha/2$). When it is determined at step 403 that the certain state of the actual camshaft phase has continued for the certain period of time, it is determined that the lock operation by the lock-time retard control is failed, and thereby control proceeds to step 404, where the lock-time retard control execution flag is set at "OFF" to end the lock-time retard control, and the lock-time retard control execution flag is set at "ON". Thereby, the lock operation by the lock-time retard control is executed based on the lock-time retard control routine of FIG. 8.

It should be noted that both the determination results at step 402 and step 403 are "No", the present routine is ended without executing any process.

Based on each of the routine described in FIGS. 6 to 9, the lock operation by the lock-time retard control and the lock operation by the lock-time advance control are alternately executed until it is determined that the lock has been completed. When it is determined that the lock has not been completed even after the above operations have been repeated by a predetermined number of times, the learning value of the intermediate lock phase may be reset to be an initial value, or alternatively, the determination criteria for determining the completion of the lock (determination criteria at step 302 and step 402) may be lowered. In other words, when it is determined that the lock has not been completed even after the lock operation by the lock-time retard control and the lock operation by the lock-time advance control have been alternately repeated by the predetermined number of times, the learning value of the intermediate lock phase may be wrong, or the determination criteria of the completion of the lock may be too strict. Thereby, it may be erroneously determined that the lock has not been completed although the lock state is established actually. In order to deal with the above erroneous determination, the learning value of the intermediate lock phase is reset to be the initial value, and then the learning operation of learning the intermediate lock phase may be executed from the beginning. Also, the determination criteria of the completion of the lock may be lowered, and then the learning operation of the intermediate lock phase may be executed from the beginning.

Further, in a case, where it is determined that the lock has not been completed even after the lock operations are repeated by the predetermined number of times after the resetting of the learning value or the lowering of the determination criteria, it is determined that the lock abnormality (that is, failure of the intermediate lock mechanism 50) occurs.

[Lock Release Control Routine]

Figure 10:
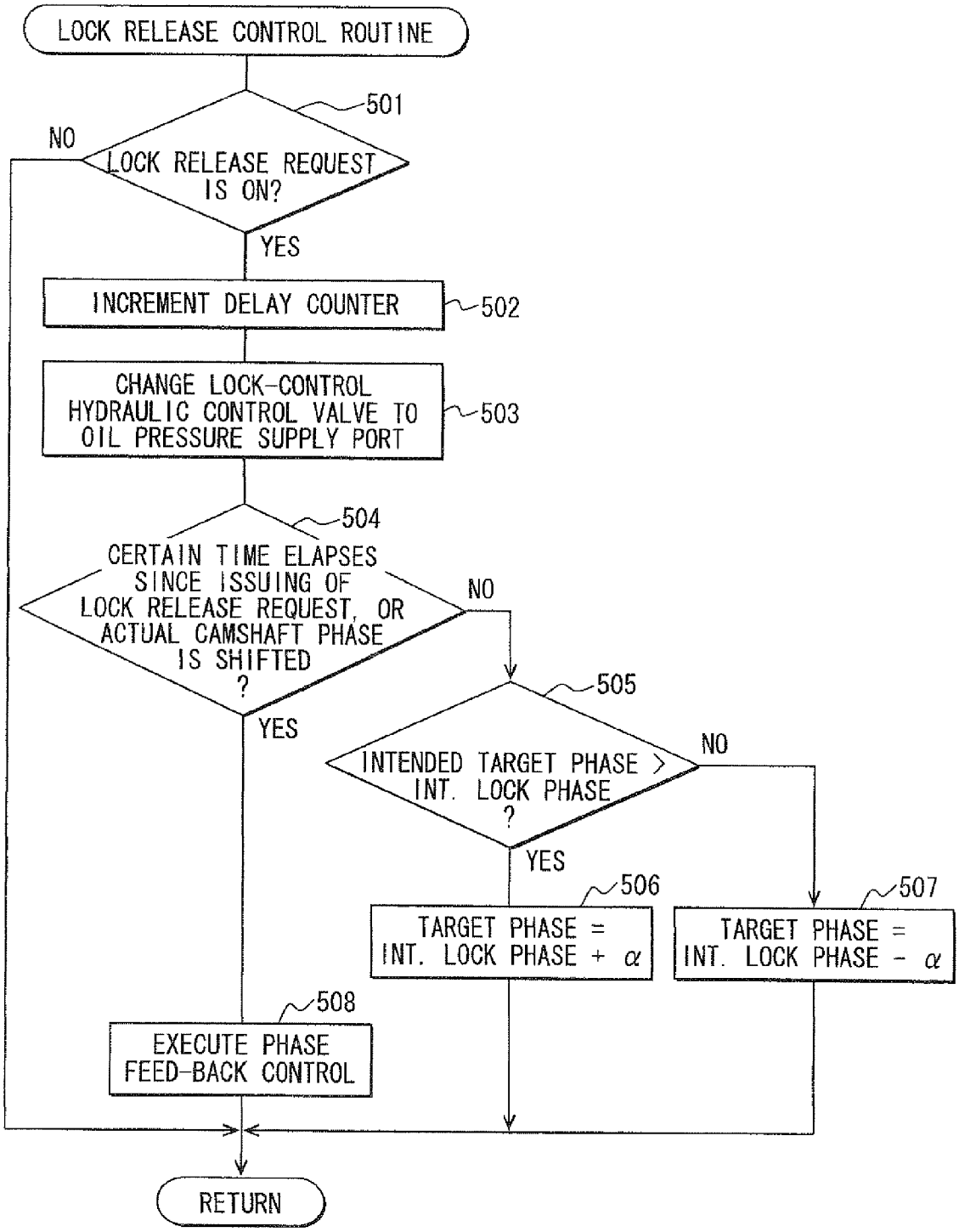
FIG. 10 is a flow chart illustrating a process of a lock release control routine of the first embodiment.
Figure 11:
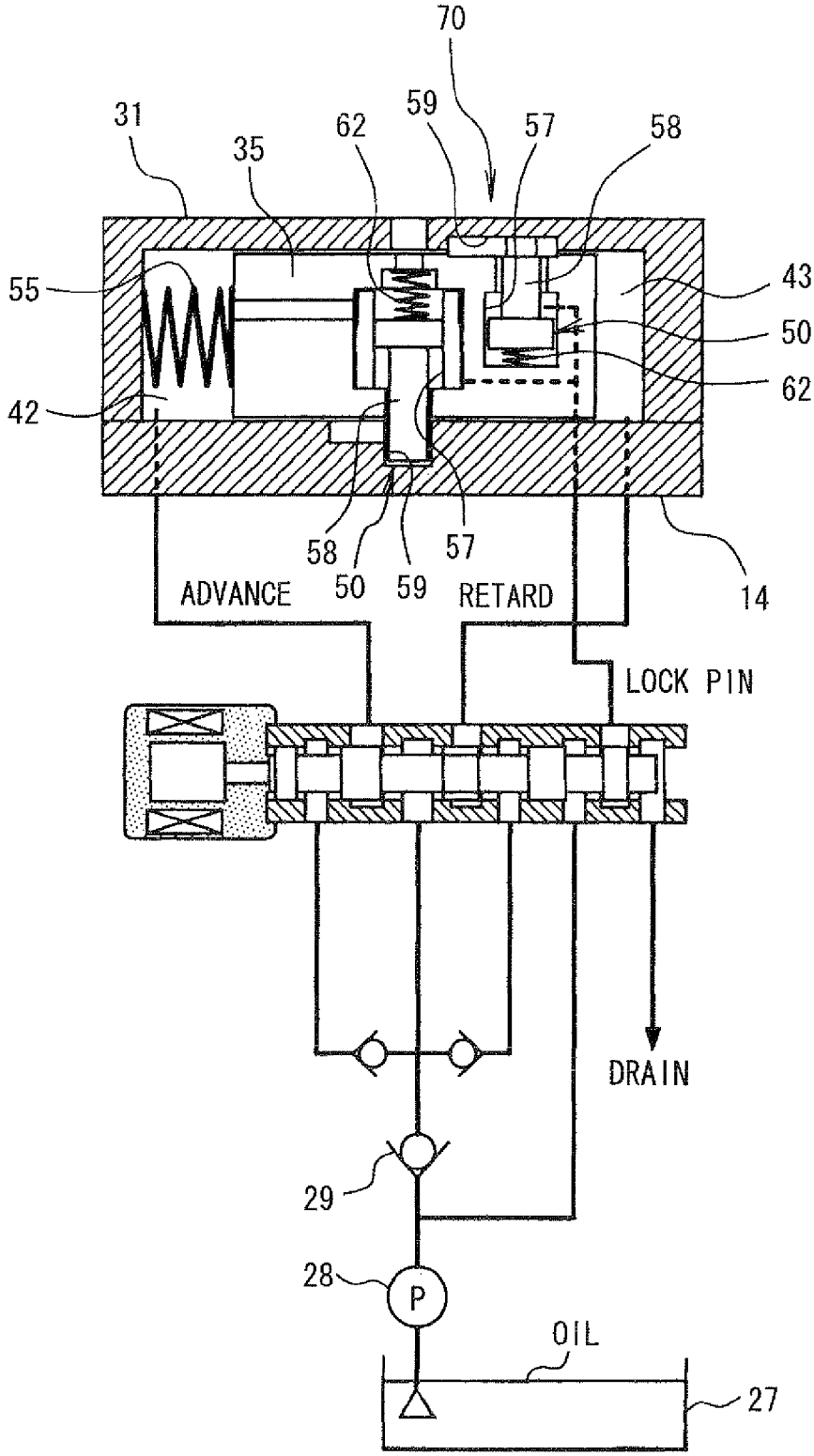
FIG. 11 is a diagram for explaining a variable valve timing unit and a hydraulic control circuit (hydraulic control unit) according to a second embodiment of the present invention.

A lock release control routine of FIG. 10 is repeated at certain intervals during the engine operation, and serves as lock release control means. When the present routine is started, firstly, it is determined at step 501 whether the lock release request is "ON" (or whether the lock release request has been issued). When the lock release request is "OFF", the present routine is ended without executing the subsequent process.

In contrast, when it is determined at step 501 that the lock release request is "ON", control proceeds to step 502, where a delay counter is incremented. The delay counter indicates a count that corresponds to a delay time between (a) the issuing of the lock release request and (b) completion of change of the operation mode to the phase feed-back control mode. At step 503, the operational position of the lock-control hydraulic control valve 26 is changed from the drain port to the oil pressure supply port, and the lock release hydraulic chamber within the lock pin receiving hole 57 is supplied with oil pressure. Thus, the lock pin 58 is actuated in the lock release direction to release the lock.

Then, control proceeds to step 504, where it is determined whether a certain time has elapsed since a time of the issuing of the lock release request. Alternatively, it is determined at step 504 whether the actual camshaft phase has been shifted to go beyond the intermediate lock phase by the degree equal to or greater than the certain amount (for example, $\alpha/2$). When it is determined at step 504 that the certain time has elapsed since the time of the issuing of the lock release request or that the actual camshaft phase is shifted to go beyond the intermediate lock phase by the degree, it is determined that the lock release has been completed. Thus, control proceeds to step 508, where the operation mode is changed to the phase feed-back control mode. Thus, the target phase is computed based on the engine operational condition, and then the control duty of the phase-control hydraulic control valve 25 is feed-back controlled such that the actual camshaft phase of the intake camshaft 16 becomes the target phase.

In contrast, when the determination result at step 504 corresponds to "No", it is determined that the lock release has not been completed. Thus, control proceeds to step 505, where it is determined whether intended target phase is on the advance side of the intermediate lock phase. When it is determined at step 505 that the intended target phase (the target phase in the phase feed-back control) is on the advance side of the intermediate lock phase, control proceeds to step 506, where the target phase of the lock release control is set to a phase (intermediate lock phase +α) that is greater than the intermediate lock phase by the certain amount α in the advance direction. Thus, the phase-control hydraulic control valve 25 is controlled such that the actual camshaft phase becomes the target phase. In the above case, the intermediate lock phase may employ the learning value of the intermediate lock phase, the design value, or the median or the average value of the manufacture variation range. Also, the certain amount α may be set such that the target phase (intermediate lock phase +α) is located slightly apart from the dead zone range in the advance.

Also, when it is determined at step 505 that the intended target phase is on the retard side of the intermediate lock phase, control proceeds to step 507, where the target phase of the lock release control is set as a phase (intermediate lock phase −α) that is smaller than (or is different from) the intermediate lock phase by the certain amount α in the retard direction. As a result, the phase-control hydraulic control valve 25 is controlled such that the actual camshaft phase becomes the target phase. In the above, the certain amount α may be set such that the target phase (intermediate lock phase −α) is located slightly apart from the dead zone range in the retard direction.

According to the first embodiment, at the time of execution of the lock control, even if the actual camshaft phase stops around the intermediate lock phase, it is not yet determined the lock has been completed at this time. In the above case, the control duty of the phase-control hydraulic control valve 25 is changed by a certain amount in order to shift the actual camshaft phase. If the actual camshaft phase remains stopping even after the change of the control duty, it is finally determined that the lock has been completed. Thus, when the actual camshaft phase stops at a position slightly away from the intermediate lock phase due to some reasons (for example, an operational condition, such as oil temperature), the erroneous determination of the completion of the lock is prevented effectively. As a result, the actual camshaft phase is reliably locked at the intermediate lock phase. Also, the determination of the completion of the lock is reliably achieved.

Second Embodiment

The above first embodiment illustrates a configuration that has the phase-control hydraulic control valve 25 and the lock-control hydraulic control valve 26, which are independent from each other. More specifically, the phase-control hydraulic control valve 25 independently controls oil pressure that actuates the variable valve timing unit 18, and the lock-control hydraulic control valve 26 independently controls oil pressure that actuates the lock pin 58. However, in the second embodiment shown in FIGS. 11 to 20, a hydraulic control valve 71 is singularly employed instead. More specifically, the hydraulic control valve 71 integrally has both (a) phase-control hydraulic control valve function for controlling oil pressure that actuates a variable valve timing unit 70 and (b) lock-control hydraulic control valve function for controlling oil pressure that actuates the lock pin 58.

A configuration of the variable valve timing unit 70 of the second embodiment is substantially similar to a configuration of the variable valve timing unit 18 of the first embodiment. Thus, the numerals same with the first embodiment are used in the description below.

Figures 12A, 12B:
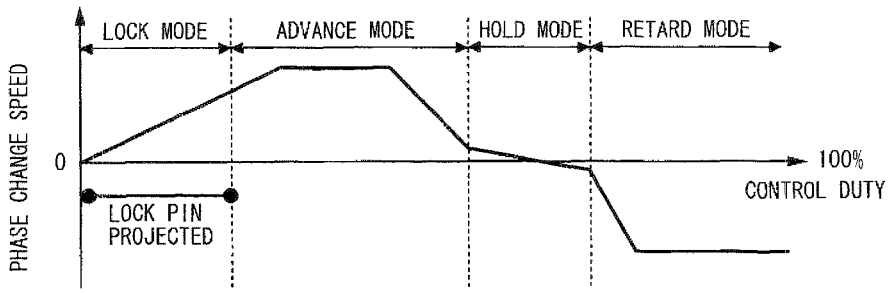
FIG. 12A is a diagram for explaining a switching pattern for switching an operational state of an advance port, a retard port, and a lock pin control port of a hydraulic control valve of the second embodiment.
FIG. 12B is a control characteristic diagram of the hydraulic control valve for explaining relation between (a) a phase change speed and (b) four control ranges of a control duty including a lock mode, an advance operation mode, a hold mode, a retard operation mode.

As above, the hydraulic control valve 71 integrally has the phase-control hydraulic control valve function and the lock-control hydraulic control valve function, and is, for example, an eight-port and four-position spool valve. As shown in FIGS. 12A and 12B, the operation mode of the hydraulic control valve 71 is categorized in four modes in accordance with the control duty of the hydraulic control valve 71. For example, the four modes include a lock mode (slight advance operation mode), an advance operation mode, a hold mode, and a retard operation mode.

When the operation mode is in the lock mode (slight advance operation mode), a lock pin control port of the hydraulic control valve 71 is brought into communication with the drain port such that oil pressure in the lock release hydraulic chamber within the lock pin receiving hole 57 is released, and thereby the spring 62 urges the lock pin 58 in the lock direction (projection direction). Also, a retard port of the hydraulic control valve 71 is brought into communication with the drain port such that oil pressure in the retard chambers 43 are released. In the above communication state, a restrictor in an oil passage connected with an advance port of the hydraulic control valve 71 is slowly changed in accordance with the control duty of the hydraulic control valve 71 such that oil is slowly supplied to the advance chambers 42 through the advance port. As a result, the actual camshaft phase is gently shifted in the advance direction.

When the operation mode is in the advance operation mode (second operation mode), the retard port of the hydraulic control valve 71 is brought into communication with the drain port such that oil pressure in the retard chamber 43 is released. In the above operation state, oil pressure supplied to the advance chambers 42 through the advance port of the hydraulic control valve 71 is changed in accordance with the control duty of the hydraulic control valve 71. As a result, the actual camshaft phase is shifted in the advance direction (reference direction).

When the operation mode is in the hold mode, oil pressure in both the advance chamber 42 and the retard chamber 43 are maintained such that the actual camshaft phase is prevented from shifting.

When the operation mode is in the retard operation mode (first operation mode), the advance port of the hydraulic control valve 71 is brought into communication with the drain port such that oil pressure in the advance chambers 42 are released. In the above operation state, oil pressure supplied to the retard chambers 43 through the retard port of the hydraulic control valve 71 is changed in accordance with the control duty of the hydraulic control valve 71 such that the actual camshaft phase is shifted in the retard direction (opposite direction opposite from the reference direction).

When the operation mode is in the control mode other than the lock mode (such as the retard operation mode, the hold mode, the advance operation mode), the lock release hydraulic chamber within the lock pin receiving hole 57 is filled with oil in order to increase oil pressure in the lock release hydraulic chamber. As a result, the increased pressure of oil pulls the lock pin 58 out of the lock hole 59 such that the lock of the lock pin 58 is released. In other words, the increased oil pressure disengages the lock pin 58 from the lock hole 59 such that the lock of the camshaft phase by the lock pin 58 is released.

It should be noted that in the second embodiment, the control mode is changed in the order from the lock mode (slight advance operation mode), the advance operation mode, the hold mode, to the retard operation mode in accordance of the increase of the control duty of the hydraulic control valve 71. However, for example, the control mode may be alternatively changed in the order of the retard operation mode, the hold mode, the advance operation mode, and the lock mode (slight advance operation mode) in accordance with the increased of the control duty of the hydraulic control valve 71. Further alternatively, the control mode may be changed in the other order of the lock mode (slight advance operation mode), the retard operation mode, the hold mode, and the advance operation mode. Also, in a case, where a control range of the lock mode (slight advance operation mode) is directly adjacent to a control range of the retard operation mode, the operation of the hydraulic control valve 71 in the control range for the lock mode (slight advance operation mode) may be executed as follows. For example, in the lock mode, oil pressure in the lock release hydraulic chamber within the lock pin receiving hole 57 is released, and the spring 62 is caused to urge the lock pin 58 in the lock direction. Simultaneously, the advance port is brought into communication with the drain port such that oil pressure is the advance chamber 42 is released. In the above operation condition, an operational state of the restrictor of the oil passage connected with the retard port is slowly changed in accordance with the control duty of the hydraulic control valve 71 such that oil is slowly supplied to the retard chambers 43 through the retard port. As a result, the actual camshaft phase is gently shifted in the retard direction.

The engine control circuit 21 computes the target phase (target valve timing) based on the engine operational condition during the phase feed-back control (variable valve timing control). Then, the control duty of the hydraulic control valve 71 is feed-back controlled such that oil pressure supplied to the advance chamber 42 and the retard chambers 43 of the variable valve timing unit 70 is feed-back controlled in order to cause the actual camshaft phase of the intake camshaft 16 (actual valve timing of intake valve) to become the target phase (target valve timing).

When the lock request is issued during the phase feed-back control, the phase shift control (lock-time retard control) is executed, in which the hydraulic control valve 71 is controlled such that the actual camshaft phase is shifted to go beyond the intermediate lock phase in the direction (for example, in the retard direction in the second embodiment) that is opposite from the shift-control direction during the lock mode. Then, the operation mode is changed to the lock mode, in which the hydraulic control valve 71 is controlled such that the spring 62 is caused to urge the lock pin 58 in the lock direction, and such that the actual camshaft phase is gently shifted in the direction toward the intermediate lock phase (or in the advance direction in the second embodiment).

Furthermore, in the second embodiment, the hydraulic control valve 71 is configured such that phase shift torque in the advance direction (or in the retard direction) is adjustable in accordance with the control duty within the control range of the lock mode. When the operation mode is changed to the lock mode, the spring 62 urges the lock pin 58 in the lock direction and the actual camshaft phase is gently shifted in the direction toward the intermediate lock phase. During the above lock mode, the hydraulic control valve 71 is controlled such that the phase shift torque is gradually increased. When the actual camshaft phase stops around the intermediate lock phase, it is determined that the lock has been completed.

Present embodiment employs the hydraulic control valve 71 that integrally includes the phase-control hydraulic control valve function and the lock-control hydraulic control valve function as described above. Even in a case, where the actual camshaft phase accidentally stops at a position different from the intermediate lock phase due to some reasons (for example, condition, such as oil temperature) in the present embodiment, the above configuration and operation of the hydraulic control valve 71 is capable of effectively preventing the erroneous determination of the completion of the lock. As a result, the actual camshaft phase is reliably locked at the intermediate lock phase, and thereby the determination of the completion of the lock is reliably achieved.

Also, in the second embodiment, when it is determined that the actual camshaft phase is shifted to certainly go beyond the intermediate lock phase during the lock mode, the lock mode is cancelled. Then, the actual camshaft phase is shifted to a target phase that is further away from the intermediate lock phase relative to the target phase is in the previous retard operation mode. For example, in the current retard operation mode, the camshaft phase is shifted to a certain position that is located in the retard direction relative to (or located on a retard side of) a previous position of the camshaft phase in the previous retard operation mode. After the above retard operation mode, the operation mode is changed to the lock mode.

Also, in a case, where the actual camshaft phase has not been shifted to go beyond the intermediate lock phase even after a certain period of time since the time of starting the lock mode, and also where it is not determined that the lock has been completed, the lock mode is cancelled. Then, the actual camshaft phase is shifted to a target phase that is located closer to the intermediate lock phase relative to the target phase is in the previous shift control direction. For example, in the current retard operation mode, the camshaft phase is shifted to a certain position that is located in the advance direction relative to (or located on an advance side of) a previous position of the camshaft phase in the previous retard operation mode. After the above retard operation mode, the operation mode is changed to the lock mode.

An operation example of the lock control of the second embodiment will be described with reference to FIGS. 13 to 15.

Figure 13:
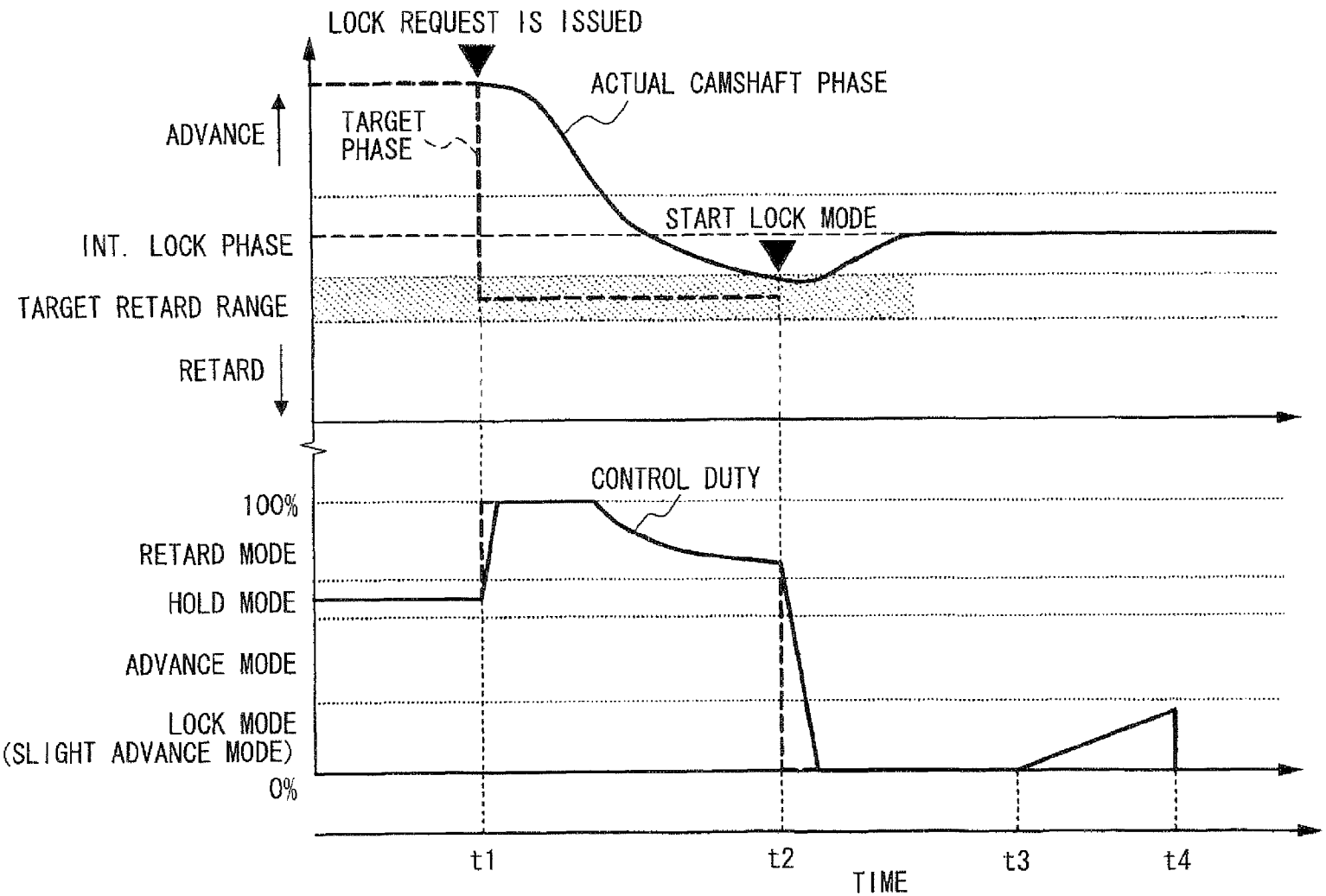
FIG. 13 is a timing chart illustrating an operation example for a case, where the lock has been completed by a first-time lock mode of the second embodiment.

FIG. 13 is an operation example, in which the lock has been completed in the first-time lock mode. In the example of FIG. 13, the actual camshaft phase is maintained at a position on the advance side of the intermediate lock phase during the hold mode before time t1. Then, the phase shift control (lock-time retard control) is executed at time t1, at which the lock request is issued during the hold mode. For example, in the phase shift control, the hydraulic control valve 71 is controlled such that the actual camshaft phase is shifted to go beyond the intermediate lock phase in the retard direction that is opposite from the shift-control direction during the lock mode. Typically, the shift-control direction during the lock mode corresponds to the advance direction in the second embodiment.

Specifically, at time t1, at which the lock request is issued, a phase shift control (lock-time retard control) for the retard operation mode is started, in which the target phase is set at a phase that is different from the intermediate lock phase in the retard direction by the certain amount. As above, the target phase is set at the phase on the retard side of the intermediate lock phase because the camshaft phase is to be shifted in the advance direction during the lock mode. Thus, at time t2, at which it is determined that the actual camshaft phase has been shifted to certainly go beyond (or to pass over) the intermediate lock phase in the retard direction, the operation mode of the hydraulic control valve 71 (or the range of the control duty of the hydraulic control valve 71) is changed from the retard operation mode to the lock mode such that the spring 62 is caused to urge the lock pin 58 in the lock direction.

As shown in FIG. 13, in a process of changing the operation mode from the hold mode to the lock mode, the control duty temporally corresponds to the control range of the advance operation mode before reaching the control range of the lock mode. As a result, a small amount of oil is supplied to the advance chambers 42, and thereby the actual camshaft phase is gently shifted in the advance direction (or in the direction toward the intermediate lock phase) even after the lock mode is started. In the example of FIG. 13, the lock pin 58 successfully locks the camshaft phase when the actual camshaft phase becomes the intermediate lock phase in the first-time lock mode, and thereby the actual camshaft phase is held at the intermediate lock phase.

Then, at time t3, at which a certain time has elapsed since the start of the lock mode, the slight advance control (control duty integration mode) is started, in which the control duty of the hydraulic control valve 71 is gradually increased within the control range of the lock mode in order to gradually increase advance torque, which serves as phase shift torque that urges the actual camshaft phase in the advance direction. Then, it is determined at time t4 that the actual camshaft phase has stably stayed around the intermediate lock phase for a certain time, and thereby it is finally determined that the lock has been completed at time t4. Then, the actual camshaft phase at the above state is stored as the learning value of the intermediate lock phase in the rewritable nonvolatile memory, such as a back-up RAM.

Figure 14:
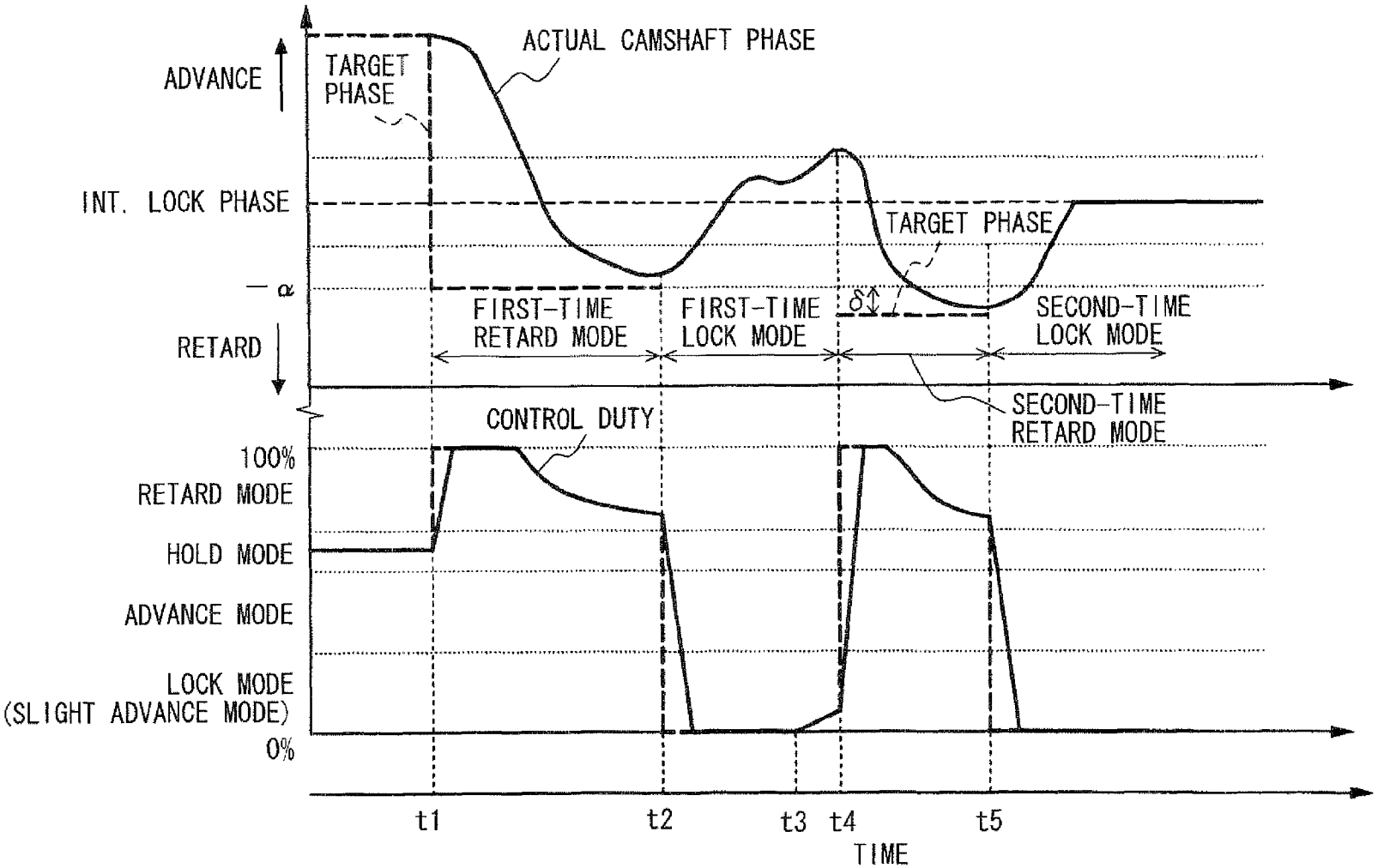
FIG. 14 is a timing chart illustrating an operation example (No. 1), in which the first-time lock mode of the second embodiment fails to lock the camshaft phase.

FIG. 14 is an operation example (No. 1), in which the first-time lock mode fails to lock the phase. The operation in the example of FIG. 14 during the first-time lock mode is similar to the operation in FIG. 13 until the slight advance control is started at time t3. During the slight advance control, it is determined at time t4 that the actual camshaft phase has been shifted to certainly go beyond the intermediate lock phase in the advance direction, and the lock mode is cancelled at time t4. Then, the actual camshaft phase is shifted to a certain phase that is located further away from the intermediate lock phase relative to a previous position of the camshaft phase is in the previous phase shift control for the first-time retard operation mode (previous first operation mode) by executing the phase shift control for the second-time retard operation mode (current first operation mode).

More specifically, the target phase of the second-time retard operation mode (current first operation mode, time t4 to time t5) is set at the certain phase that is on the retard side of the target phase in the previous phase shift control (lock-time retard control) for the first-time retard operation mode (previous first operation mode, time t1 to time t2) as shown in FIG. 14. Thus, the target phase for the phase shift control for the second-time retard operation mode is more different from the intermediate lock phase in the retard direction relative to the target phase for the first-time retard operation mode. Then, the phase shift control for the second-time retard operation mode is executed based on the newly set target phase to shift the actual camshaft phase in the retard direction. Then, the actual camshaft phase reaches the newly set target phase at time t5, and then the operation mode is changed to the second-time lock mode. The hydraulic control valve 71 is operated in the second-time lock mode similarly to the first-time lock mode.

Due to the above configuration, it is possible to reliably lock the camshaft phase at the intermediate lock phase.

Figure 15:
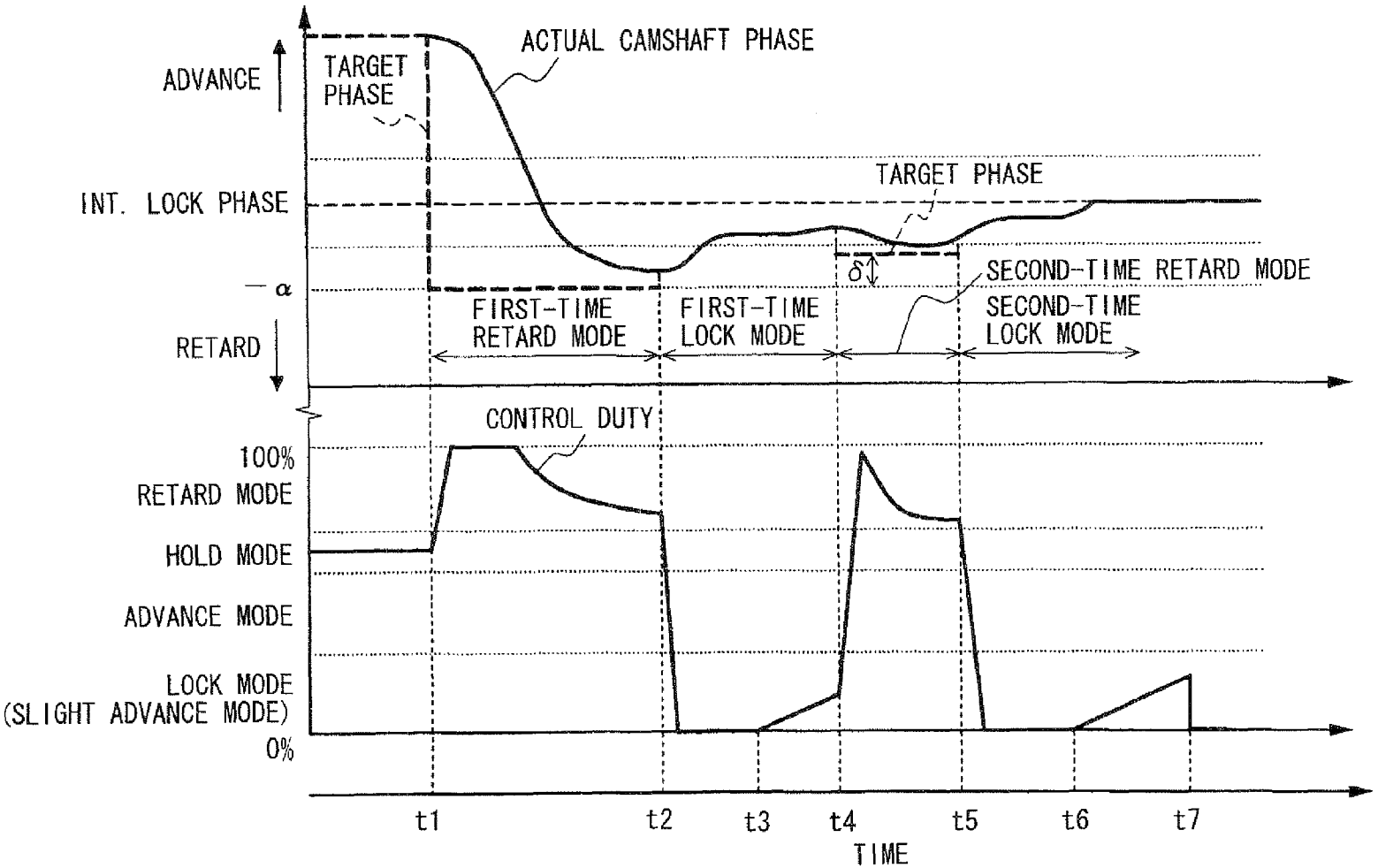
FIG. 15 is a timing chart illustrating another operation example (No. 2), in which the first-time lock mode of the second embodiment fails to lock the camshaft phase.

FIG. 15 is another operation example (No. 2), in which the first-time lock mode fails to lock the phase in a manner different from the operation example (No. 1). The operation in the example of FIG. 15 during the first-time lock mode is similar to the operation in FIG. 13 until the slight advance control is started at time t3. In the example of FIG. 15, at time t4, a certain time has elapsed since the start of the first-time lock mode. However, the actual camshaft phase has not been shifted to go beyond the intermediate lock phase in the advance direction at time t4, and simultaneously, it is not determined at time t4 that the lock has been completed. In the above case, the lock mode is cancelled at time t4, and the actual camshaft phase is shifted to a certain phase that is closer to the intermediate lock phase relative to the previous target phase in the phase shift control (lock-time retard control) for the first-time retard operation mode (previous first operation mode) by executing the phase shift control for the second-time retard operation mode (current first operation mode).

More specifically, the target phase of the second-time retard operation mode is set at the certain phase defined between the intermediate lock phase and the previous target phase of the phase shift control for the first-time retard operation mode. Then, the phase shift control for the second-time retard operation mode is executed based on the newly set target phase to shift the actual camshaft phase in the retard direction. Then, the actual camshaft phase reaches the newly set target phase at time t5. Then, the operation mode is changed to the second-time lock mode. The hydraulic control valve 71 is operated in the second-time lock mode in a manner similarly to the first-time lock mode. As shown in, FIG. 15, the slight advance control is started at time t6, and it is finally determined that the lock has been completed at time t7, at which it is determined that the actual camshaft phase has stayed around the intermediate lock phase for a certain time.

Due to the above configuration, it is possible to reliably lock the camshaft phase at the intermediate lock phase.

In the second embodiment, in a case, where it is not determined that the lock has been completed even after the repetition of the lock mode for the number of times that is equal to or greater than the predetermined number of times, the learning value of the intermediate lock phase may be reset to be the initial value, or the determination criteria of the completion of the lock may be lowered. Furthermore, even in another case, where it is not determined that the lock has been completed even after the number of the repetition of the lock mode again exceeds the predetermined number of times after the resetting of the learning value or the lowering of the determination criteria, it is determined that lock abnormality (failure of the intermediate lock mechanism 50) occurs.

The above lock control of the second embodiment is executed by the engine control circuit 21 based on each of routines shown in FIGS. 16 to 20. Each of the routines will be described.

[Lock Control Main Routine]

Figure 16:
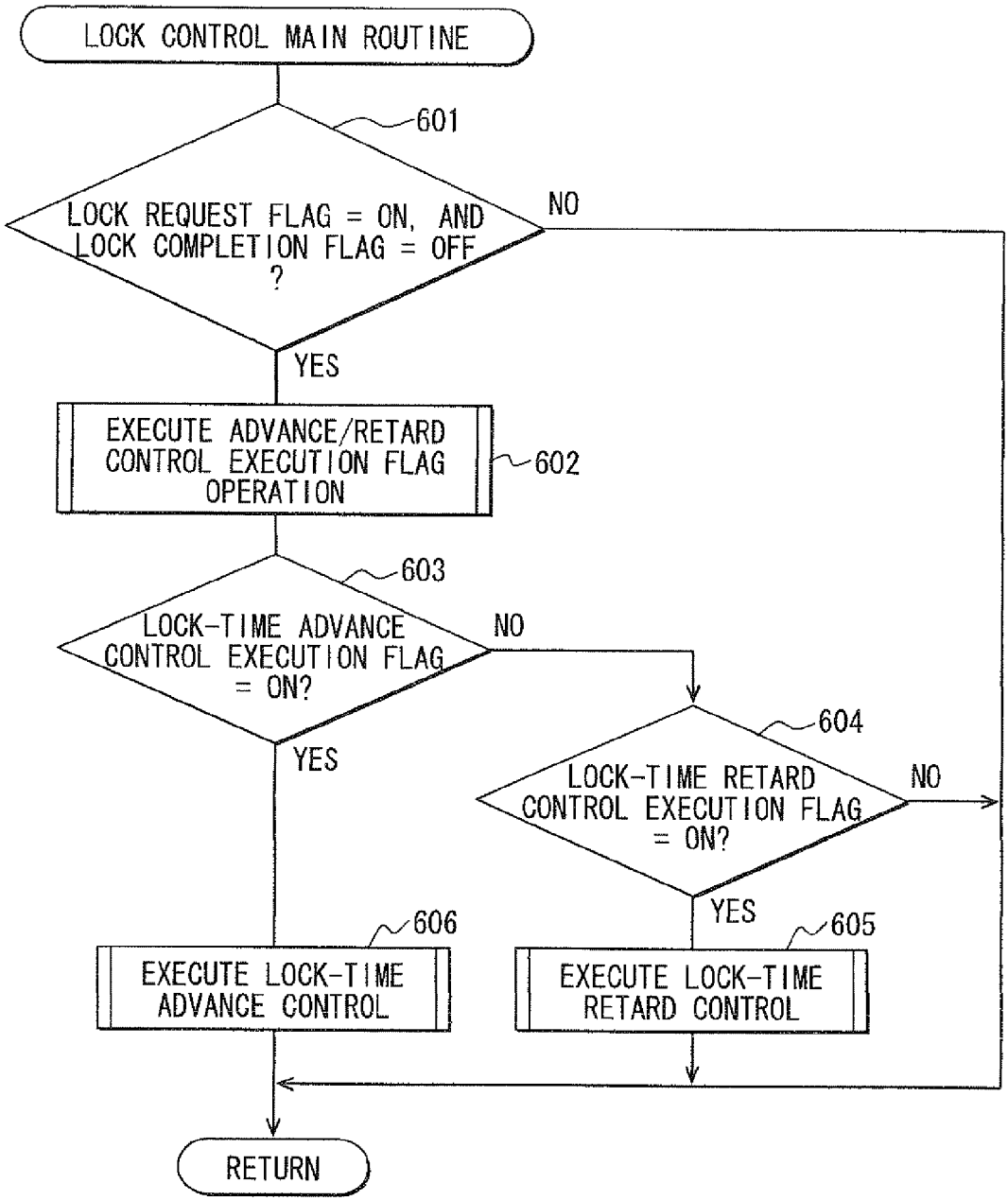
FIG. 16 is a flow chart illustrating a process of a lock control main routine of the second embodiment.

A lock control main routine of FIG. 16 is repeatedly executed at certain intervals during the engine operation and serves as lock control means. When the present routine is started, it is determined at step 601 whether a lock control execution condition is satisfied. For example, the lock control execution condition is satisfied when a lock request flag is "ON", corresponding to that there is the lock request, and simultaneously when the lock completion flag is "OFF", corresponding to that the lock has not been completed. When it is determined that at least one of the conditions (lock request flag=OFF and lock completion flag=ON) is true, the lock control execution condition is not satisfied. Thus, the present routine is ended without executing the subsequent process.

In contrast, when it is determined at step 601 that lock request flag=ON and the lock completion flag=OFF, the lock control execution condition is satisfied. Thus, the process for the lock control at and after step 602 will be executed. Firstly, an advance and retard control execution flag operation routine of FIG. 17 (described later) will be executed at step 602 such that an ON/OFF state of each of the lock-time retard control execution flag and the lock-time advance control execution flag is change. In the above routine of FIG. 17, for example, the ON/OFF state of the lock-time retard control execution flag is changed depending on whether the execution condition of the lock-time retard control for shifting the actual camshaft phase in the retard direction is satisfied. Also, the ON/OFF state of the lock-time advance control execution flag is changed depending on whether the execution condition of the lock-time advance control for shifting the actual camshaft phase in the advance direction is satisfied.

Then, control proceeds to step 603, where it is determined whether the lock-time advance control execution flag is "ON" indicating that the lock-time advance control execution condition is satisfied. When it is determined that the lock-time advance control execution flag is "ON" (or the execution condition of the lock-time advance control is satisfied), control proceeds to step 606, where a lock-time advance control routine of FIG. 18 (described later) is executed.

In contrast, when it is determined at step 603 that the lock-time advance control execution flag is "OFF" indicating that the lock-time advance control execution condition is not satisfied, control proceeds to step 604, where it is determined whether the lock-time retard control execution flag is "ON" indicating that the lock-time retard control execution condition is satisfied. When it is determined that the lock-time retard control execution flag is "ON" (or the execution condition of the lock-time retard control is satisfied), control proceeds to step 605, where a lock-time retard control routine of FIG. 19 (described later) is executed.

It should be noted that when all of the determination results at step 603 and step 604 correspond to "No", both of the lock-time retard control and the lock-time advance control will not be executed.

[Advance and Retard Control Execution Flag Operation Routine]

Figure 17:
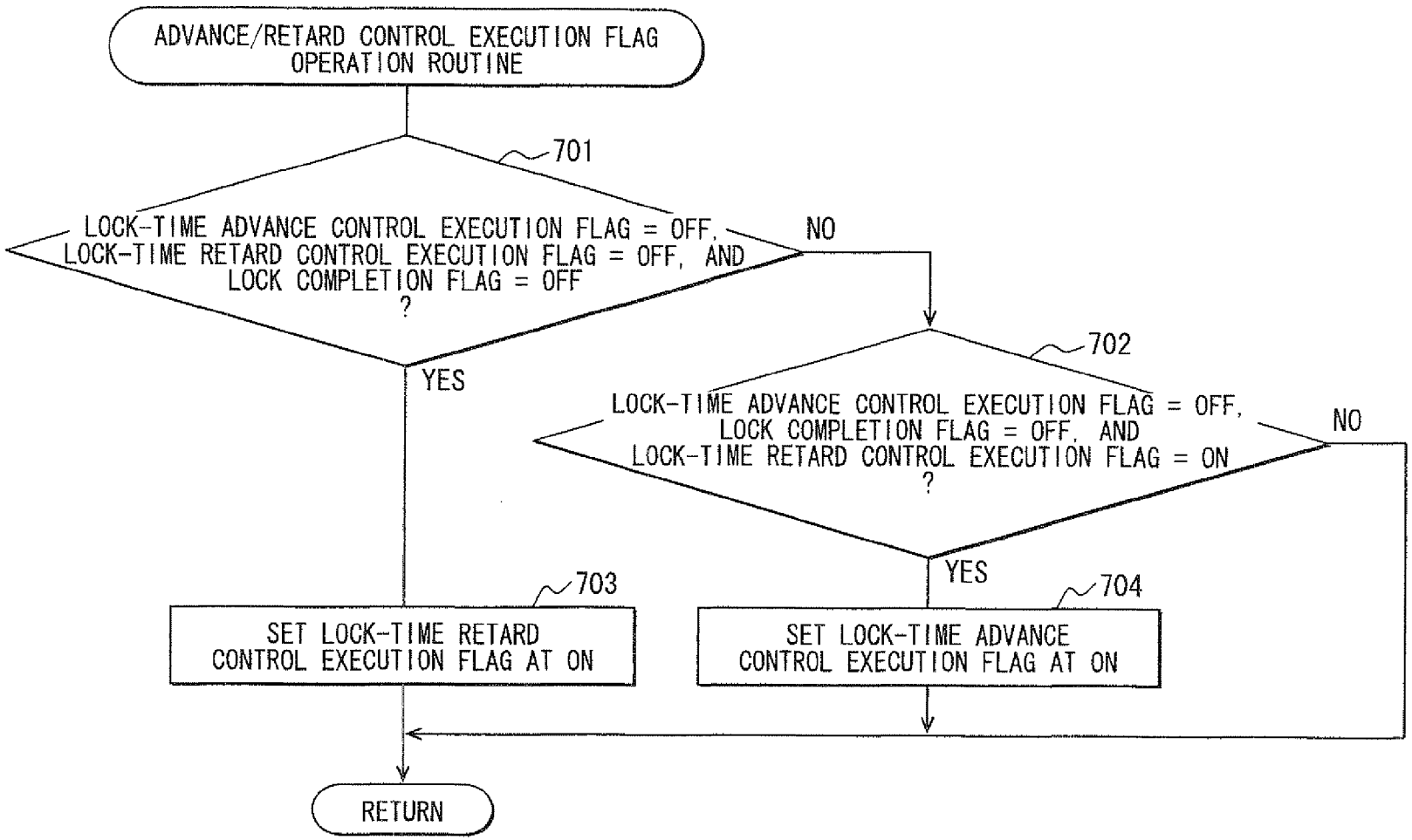
FIG. 17 is a flow chart illustrating a process of an advance and retard control execution flag operation routine of the second embodiment.

The advance and retard control execution flag operation routine of FIG. 17 is a subroutine executed at step 602 of the lock control main routine of FIG. 16. When the present routine is started, firstly, it is determined at step 701 whether all of the lock-time advance control execution flag, the lock-time retard control execution flag, and the lock completion flag are "OFF". When all of the above three flags are "OFF", control proceeds to step 703, where the lock-time retard control execution flag is set at "ON" to end the present routine.

In contrast, when it is determined at step 701 that one or more of the above three flags is set at "ON", control proceeds to step 702, where it is determined whether both of the lock-time advance control execution flag and the lock completion flag are "OFF", and simultaneously the lock-time retard control execution flag is "ON". When the determination result at step 701 corresponds to "Yes", control proceeds to step 704, where the lock-time advance control execution flag is set at "ON" to end the present routine.

When both of the determination results at step 701 and step 702 correspond to "No", the present routine is ended without executing any process.

[Locked-Time Advance Control Routine]

Figure 18:
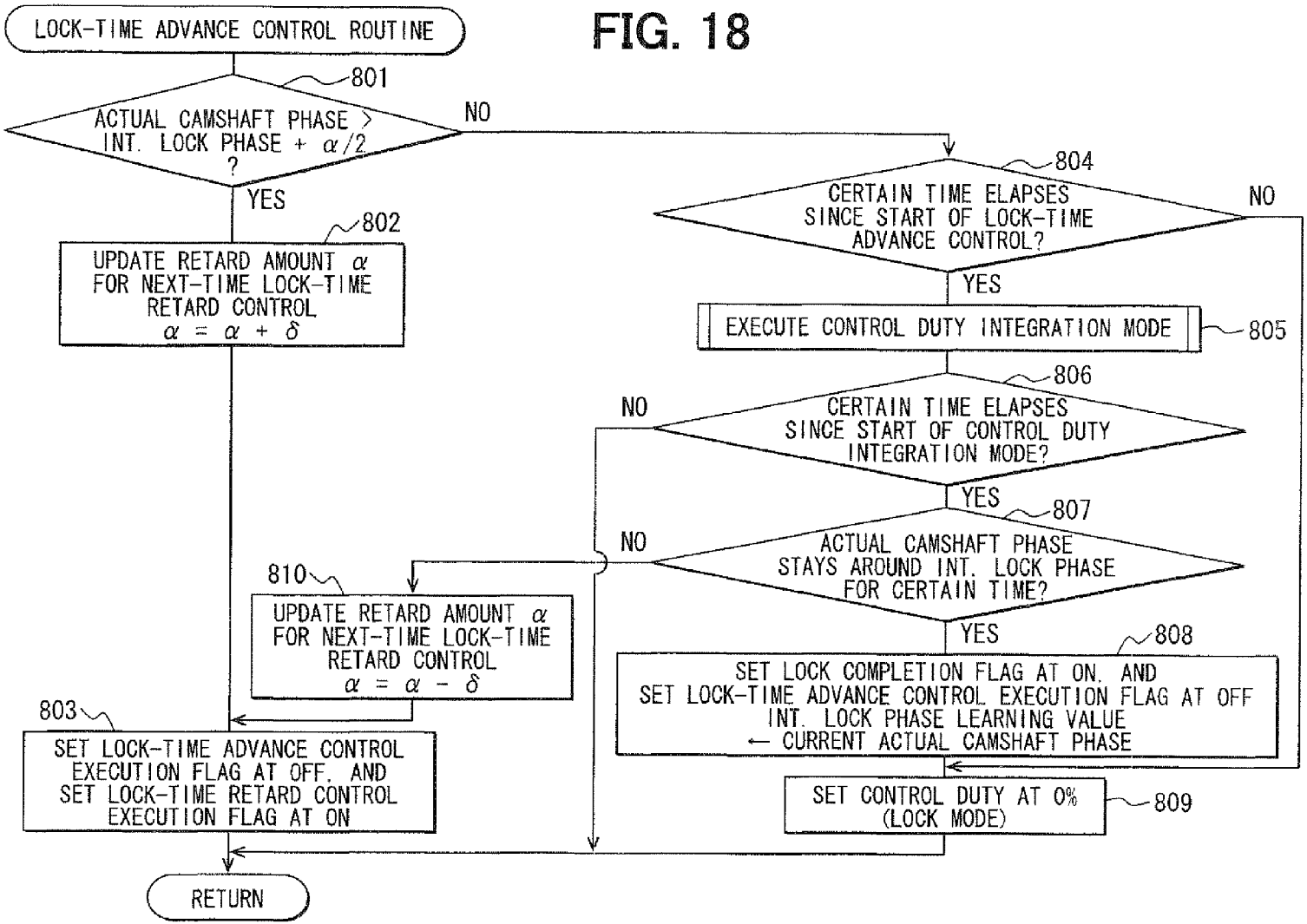
FIG. 18 is a flow chart illustrating a process of a lock-time advance control routine of the second embodiment.

The lock-time advance control routine of FIG. 18 is a subroutine executed at step 606 of the lock control main routine of FIG. 16. When the present routine is started, firstly, it is determined at step 801 whether the actual camshaft phase has been shifted to certainly go beyond intermediate lock phase in the advance direction. It is determined that the actual camshaft phase has been shifted to certainly go beyond intermediate lock phase in the advance direction when the actual camshaft phase has been shifted to go beyond the intermediate lock phase in the advance direction by a degree equal to or greater than the certain amount (for example, $\alpha/2$). When it is determined that the actual camshaft phase has been shifted to go beyond the intermediate lock phase in the advance direction by the degree, it is determined that the lock operation by the lock mode is failed. Then, control proceeds to step 802, where a retard amount $\alpha$, which is a difference from the intermediate lock phase in the retard direction used during a next-time lock-time retard control, is incremented by a certain amount $\delta$.

$$\alpha=\alpha+\delta$$

Then, control proceeds to step 803, where the lock-time advance control execution flag is set at "OFF" to end the lock-time advance control. Also, the lock-time retard control execution flag is set at "ON". Due to the above, the determination result of step 604 of the rock control main routine in FIG. 16 corresponds to "YES" in the next execution of the rock control main routine, and thereby the lock-time retard control of step 605 in FIG. 16 will be executed. More specifically, the lock-time retard control of step 605 corresponds the lock-time retard control routine of FIG. 19 (described later), and the actual camshaft phase is shifted to a position that is more away from the intermediate lock phase relative to the position of the actual camshaft phase is in the previous lock-time retard control (or in the phase shift control for the previous retard operation mode).

In contrast, when it is determined at step 801 that the actual camshaft phase has not been shifted in the advance direction to go beyond the intermediate lock phase by a degree equal to or greater than the certain amount (for example, $\alpha/2$), in other word, when it is not confirmed that the actual camshaft phase has been shifted to go beyond the intermediate lock phase in the advance direction, control proceeds to step 804. At step 804, it is determined whether a certain time has elapsed since the start of the lock-time advance control (or the start of the lock mode). When it is determined that the certain time has not elapsed, control proceeds to step 809, where the control duty of the hydraulic control valve 71 is set at a reference control duty (0%) for the lock mode in order to continue the lock mode.

When it is determined at step 804 that the certain time has elapsed since the start of the lock-time advance control (or the start of the lock mode), control proceeds to step 805, where a control duty integration mode routine of FIG. 20 (described later) is executed, in which a control duty integration mode (slight advance control) is executed to gently increase the control duty of the hydraulic control valve 71.

Then, control proceeds to step 806, where it is determined whether the certain time has elapsed since the start of integrating the control duty of the hydraulic control valve 71 (the start of the slight advance control). When it is not determined that the certain time has elapsed, the present routine is ended without executing any process.

When it is determined at step 806 that the certain time has elapsed since the start of the integration of the control duty of the hydraulic control valve 71 (or the start of the slight advance control), control proceeds to step 807, where it is determined whether the actual camshaft phase stays around the intermediate lock phase for a certain time period. In the above, the determination of whether the actual camshaft phase stays around the intermediate lock phase may be made, for example, by determining whether the actual camshaft phase stays within an error range based on the learning value of the intermediate lock phase. Alternatively, the learning value may be the design value, the median, or average value.

When it is determined at step 807 that the actual camshaft phase stays around the intermediate lock phase for the certain time period, it is determined that the lock has been completed, and thereby control proceeds to step 808. At step 808, the lock completion flag is set at "ON", and the lock-time advance control execution flag is set at "OFF". Also, at step 808, the current actual camshaft phase is stored as the learning value of the intermediate lock phase in the rewritable nonvolatile memory (storage device), such as the back-up RAM. The above updated learning value of the intermediate lock phase is used during the execution of the lock control and the lock release control. At the following step 809, the control duty of the hydraulic control valve 71 is set at the reference control duty (0%) for the lock mode in order to continue the lock mode.

In contrast, when it is not determined at step 807 that the actual camshaft phase has stayed around the intermediate lock phase for the certain time period, control proceeds to step 810, where a retard amount $\alpha$, by which the camshaft phase is positioned away from the intermediate lock phase in the retard direction during the execution of the lock-time retard control next-time, is reduced by a certain amount $\delta$.

$$\alpha=\alpha-\delta$$

Then, control proceeds to step 803, the lock-time advance control execution flag is set at "OFF" to end the lock-time advance control, and the lock-time retard control execution flag is set at "ON". Due to the above, the determination result of step 604 of the rock control main routine in FIG. 16 corresponds to "YES" in the next execution of the rock control main routine, and thereby the lock-time retard control of step 605 in FIG. 16 will be executed. More specifically, the lock-time retard control of step 605 corresponds the lock-time retard control routine of FIG. 19, and the actual camshaft phase is shifted to a position that is closer to the intermediate lock phase relative to the previous position of the actual camshaft phase is in the previous lock-time retard control (or in the phase shift control for the previous retard operation mode).

[Lock-Time Retard Control Routine]

Figure 19:
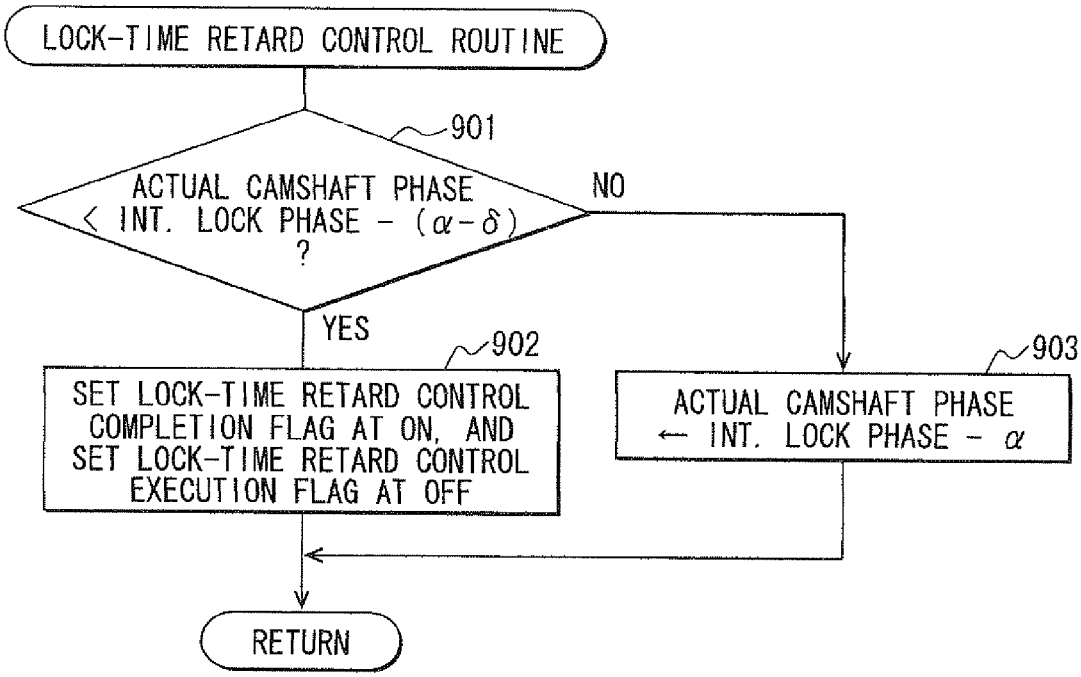
FIG. 19 is a flow chart illustrating a process of a lock-time retard control routine of the second embodiment.

The lock-time retard control routine of FIG. 19 is a subroutine executed at step 605 of the lock control main routine of FIG. 16. When the present routine is started, firstly, it is determined at step 901 whether the actual camshaft phase has been shifted to go beyond the intermediate lock phase in the retard direction by a degree equal to or greater than a certain amount ($\alpha-\delta$) due to the lock-time retard control such that the actual camshaft phase is positioned on the retard side of the phase [intermediate lock phase $-(\alpha-\delta)$]. When it is determined that the actual camshaft phase has been shifted to go beyond the phase [intermediate lock phase $-(\alpha-\delta)$] in the retard direction, control proceeds to step 902, where the lock-time retard control completion flag is set at "ON", and the lock-time retard control execution flag is set at "OFF".

In contrast, when it is not determined at step 901 that the lock-time retard control has shifted the actual camshaft phase to go beyond the phase [intermediate lock phase $-(\alpha-\delta)$] in the retard direction, control proceeds to step 903, where the target phase of the lock release control is set at a phase (intermediate lock phase $-\alpha$) that is different from the intermediate lock phase by a certain amount $\alpha$ in the retard direction.

[Control duty integration mode Routine]

Figure 20:
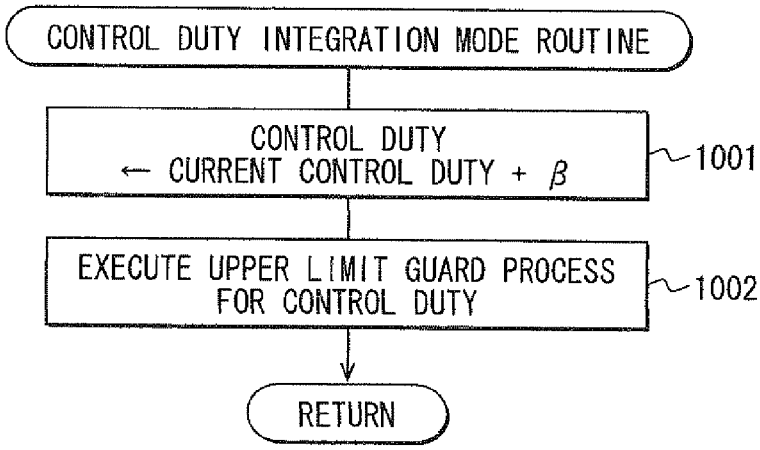
FIG. 20 is a flow chart illustrating a process of a control duty integration mode routine of the second embodiment.

The control duty integration mode routine of FIG. 20 is a subroutine executed at step 805 of the lock-time advance control routine of FIG. 18. When the present routine is started, firstly, at step 1001, a new control duty is set by adding a predetermined value $\beta$ to a current control duty. Then, control proceeds to step 1002, where an upper limit guard process for the control duty is executed. Specifically, in the upper limit guard process, when the computed value of the control duty exceeds an upper limit value of the control range of the lock mode, the upper limit value of the lock mode control range is set as the final control duty. In contrast, when the computed value of the control duty is equal to or less than the upper limit value, the computed value of the control duty computed at step 1001 is set as the final control duty.

In the second embodiment, a variable valve timing control system employs the hydraulic control valve 71 that integrally has the phase-control hydraulic control valve function and the lock-control hydraulic control valve function. The phase-control hydraulic control valve function controls oil pressure that actuates the variable valve timing unit 70. The lock-control hydraulic control valve function controls oil pressure that actuates the lock pin 58. In the above system of the second embodiment, when the lock request is issued, the phase shift control is executed first, in which the hydraulic control valve 71 is controlled such that the actual camshaft phase is shifted to go beyond the intermediate lock phase in a direction opposite from the shift-control direction during the lock mode. Then, the operation mode is changed to the lock mode, in which the lock pin 58 is urged in the lock direction, and in which the hydraulic control valve 71 is controlled such that the actual camshaft phase is gently shifted in the direction toward the intermediate lock phase. As a result, even for a case of the hydraulic control valve 71 integrally having the phase-control hydraulic control valve function and the lock-control hydraulic control valve function, it is possible to effectively prevent the erroneous determination of the completion of the lock when the camshaft phase stops around a position slightly different from the intermediate lock phase due to some reasons (for example, a condition of oil temperature). Thus, it is possible to reliably lock the camshaft phase at the intermediate lock phase, and also it is possible to reliably determine the completion of the lock.

It should be noted that the present invention is not limited to the variable valve timing control apparatus for the intake valve. However, the present invention may be applied to a variable valve timing control apparatus for an exhaust valve.

A configuration of the variable valve timing unit 18, 70 and a configuration of the hydraulic control valves 25, 26, 71 may be modified as required provided that the modification does not deviate from the gist of the invention.

Additional advantages and modifications will readily occur to those skilled in the art. The invention in its broader terms is therefore not limited to the specific details, representative apparatus, and illustrative examples shown and described.

What is claimed is:

1. A variable valve timing control apparatus for an internal combustion engine that has a camshaft and a crankshaft, comprising:

a variable valve timing unit adapted to adjust valve timing by shifting a camshaft phase that is a rotational angular position of the camshaft relative to a rotational angular position of the crankshaft;

a lock pin that is movable in a lock direction for locking the camshaft phase at an intermediate lock phase that is generally middle of an adjustable range of the camshaft phase;

a hydraulic control unit adapted to control oil pressure that actuates the variable valve timing unit and the lock pin; and lock control means for controlling the hydraulic control unit such that the lock pin is caused to lock the camshaft phase at the intermediate lock phase when a lock request is issued, wherein:

when the lock request is issued, the lock control means executes a phase shift control while the lock pin is urged in the lock direction, in which control the lock control means controls the hydraulic control unit such that the camshaft phase is shifted in a reference direction to go beyond the intermediate lock phase;

when the camshaft phase stops around the intermediate lock phase during the phase shift control, the lock control means changes a control amount of the hydraulic control unit by a certain amount to shift the camshaft phase; and the lock control means determines that the camshaft phase has been locked at the intermediate lock phase when the camshaft phase is limited from being shifted even after the lock control means changes the control amount of the hydraulic control unit by the certain amount.

2. The variable valve timing control apparatus according to claim 1, wherein:

the reference direction is one of an advance direction and a retard direction;

an opposite direction is the other one of the advance direction and the retard direction;

the hydraulic control unit includes a first hydraulic control valve and a second hydraulic control valve, the first hydraulic control valve controlling oil pressure that actuates the variable valve timing unit, the second hydraulic control valve controlling oil pressure that actuates the lock pin;

when the camshaft phase stops around the intermediate lock phase during the phase shift control, the lock control means changes the control amount of the first hydraulic control valve by the certain amount alternately for shifting the camshaft phase in the reference direction and for shifting the camshaft phase in the opposite direction; and the lock control means determines that the camshaft phase has been locked at the intermediate lock phase when the camshaft phase is limited from being shifted in the reference direction and in the opposite direction.

3. The variable valve timing control apparatus according to claim 2, wherein:

when the lock control means determines that the camshaft phase has been shifted to certainly go beyond the intermediate lock phase during the phase shift control, the lock control means controls the hydraulic control unit to shift the camshaft phase in the opposite direction such that the camshaft phase is shifted toward the intermediate lock phase to go beyond the intermediate lock phase in the opposite direction.

4. The variable valve timing control apparatus according to claim 1, wherein:

the reference direction is one of an advance direction and a retard direction;

an opposite direction is the other one of the advance direction and the retard direction;

the hydraulic control unit includes a hydraulic control valve, which controls oil pressure for actuating the variable valve timing unit, and which also controls oil pressure for actuating the lock pin;

the hydraulic control valve is operable in a first operation mode, a second operation mode, a hold mode, and a lock mode based on the control amount of the hydraulic control valve, the camshaft phase being shifted in the opposite direction in the first operation mode, the camshaft phase being shifted in the reference direction in the second operation mode, the camshaft phase being maintained in the hold mode, the lock pin being urged in the lock direction in the lock mode;

the hydraulic control unit is adapted to gently supply oil pressure to the variable valve timing unit such that the camshaft phase is gently shifted in the reference direction while the hydraulic control valve is operated in the lock mode;

when the lock request is issued, the lock control means controls the hydraulic control valve in the first operation mode such that the camshaft phase is shifted to go beyond the intermediate lock phase in the opposite direction;

after the lock control means controls the hydraulic control valve in the first operation mode, the lock control means controls the hydraulic control valve in the lock mode such that the camshaft phase is gently shifted toward the intermediate lock phase in the reference direction while the lock pin is urged in the lock direction.

5. The variable valve timing control apparatus according to claim 4, wherein:

the control amount of the hydraulic control valve is changeable within a control range for the lock mode;

the hydraulic control valve is adapted to adjust phase shift torque for shifting the camshaft phase in the reference direction in accordance with the control amount;

the lock control means controls the control amount of the hydraulic control valve such that the phase shift torque is gradually increased while the hydraulic control valve is operated in the lock mode; and the lock control means determines that the camshaft phase has been locked at the intermediate lock phase when the camshaft phase stops around the intermediate lock phase even after the phase shift torque is gradually increased during the lock mode.

6. The variable valve timing control apparatus according to claim 4, wherein;

when the lock control means determines that the camshaft phase has been shifted to certainly go beyond the intermediate lock phase during the lock mode, the lock control means controls the hydraulic control valve in the first operation mode, in which the camshaft phase is shifted to a certain position that is located further away from the intermediate lock phase relative to a previous position of the camshaft phase is in the previous first operation mode; and the lock control means controls the hydraulic control valve in the lock mode after the camshaft phase has been shifted to the certain position during the first operation mode.

7. The variable valve timing control apparatus according to claim 4, wherein:

when the lock control means determines that the camshaft phase is not shifted to go beyond the intermediate lock phase in the reference direction and simultaneously when the lock control means determines that the camshaft phase has not been locked at the intermediate lock phase even after a certain period of time has elapsed since a start of the lock mode, the lock control means controls the hydraulic control valve in the first operation mode, in which the camshaft phase is shifted to a certain position that is located closer to the intermediate lock phase relative to a previous position of the camshaft phase is in the previous first operation mode; and the lock control means controls the hydraulic control valve in the lock mode after the camshaft phase is shifted to the certain position in the first operation mode.

8. The variable valve timing control apparatus according to claim 4, wherein:

the camshaft phase indicates a certain value when it is determined that the lock has been completed; and the lock control means stores the certain value of the camshaft phase in a storage device as a learning value of the intermediate lock phase.

9. The variable valve timing control apparatus according to claim 8, wherein:

when the lock control means determines that the camshaft phase has not been locked at the intermediate lock phase even after the camshaft phase is shifted to go beyond the intermediate lock phase by a predetermined number of times, the lock control means resets the learning value of the intermediate lock phase to an initial value or lowers a determination criteria of determining whether the camshaft phase has been locked at the intermediate lock phase.

10. The variable valve timing control apparatus according to claim 9, wherein:

when the lock control means determines that the camshaft phase has not been locked at the intermediate lock phase even after the camshaft phase is shifted to go beyond the intermediate lock phase by a predetermined number of times after the setting of the learning value of the intermediate lock phase as the initial value or the lowering of the determination criteria, the lock control means determines that lock abnormality occurs.

11. The variable valve timing control apparatus according to claim 10, wherein:

the certain period of time is a time period measured between a time of issuing the lock release request and a time of detecting change of the camshaft phase.

12. The variable valve timing control apparatus according to claim 1, wherein:

the camshaft phase indicates a certain value when it is determined that the lock has been completed; and the lock control means stores the certain value of the camshaft phase in a storage device as a learning value of the intermediate lock phase.

13. The variable valve timing control apparatus according to claim 12, wherein:

when the lock control means determines that the camshaft phase has not been locked at the intermediate lock phase even after the camshaft phase is shifted to go beyond the intermediate lock phase by a predetermined number of times, the lock control means resets the learning value of the intermediate lock phase to an initial value or lowers a determination criteria of determining whether the camshaft phase has been locked at the intermediate lock phase.

14. The variable valve timing control apparatus according to claim 13, wherein:

when the lock control means determines that the camshaft phase has not been locked at the intermediate lock phase even after the camshaft phase is shifted to go beyond the intermediate lock phase by a predetermined number of times after the setting of the learning value of the intermediate lock phase as the initial value or the lowering of the determination criteria, the lock control means determines that lock abnormality occurs.

15. A variable valve timing control apparatus for an internal combustion engine that has a camshaft and a crankshaft, comprising:

a variable valve timing unit adapted to adjust valve timing by shifting a camshaft phase that is a rotational angular position of the camshaft relative to a rotational angular position of the crankshaft;

a lock pin that is movable in a lock direction for locking the camshaft phase at an intermediate lock phase that is generally middle of an adjustable range of the camshaft phase;

a hydraulic control unit adapted to control oil pressure that actuates the variable valve timing unit and the lock pin, wherein:

operation of the hydraulic control unit is changeable between a lock mode and a phase feed-back control mode;

when the hydraulic control unit is operated in the lock mode, the lock pin locks the camshaft phase at the intermediate lock phase; and when the hydraulic control unit is operated in the phase feed-back control mode, the variable valve timing unit controls the camshaft phase at a target phase; and lock release control means for controlling the hydraulic control unit such that the lock pin is actuated in a lock release direction for releasing the locked camshaft phase when a lock release request is issued during the lock mode, wherein:

the lock release control means is prevented from changing the operation of the hydraulic control unit to the phase feed-back control mode and the lock release control means controls the hydraulic control unit such that the camshaft phase is controlled around the intermediate lock phase while the lock pin is actuated in the lock release direction until a certain period of time elapses since the lock release request is issued; and the lock release control means changes the operation of the hydraulic control unit to the phase feed-back control mode after the certain period of time elapses since the lock release request is issued.

16. The variable valve timing control apparatus according to claim 15, wherein:

when a control amount of the hydraulic control unit is set at a hold control amount, the camshaft phase is maintained;

when the target phase is on an advance side of the intermediate lock phase, the lock release control means sets the control amount of the hydraulic control unit at a value greater than the hold control amount in an advance direction by a certain amount before the certain period of time has elapsed since the lock release request is issued; and when the target phase is on a retard side of the intermediate lock phase, the lock release control means sets the control amount of the hydraulic control unit at a value greater than the hold control amount in a retard direction by a certain amount before the certain period of time has elapsed since the lock release request is issued.

* * * * *